US007149320B2

(12) United States Patent
Haykin et al.

(10) Patent No.: US 7,149,320 B2
(45) Date of Patent: Dec. 12, 2006

(54) BINAURAL ADAPTIVE HEARING AID

(75) Inventors: Simon Haykin, Ancaster (CA); Sue Becker, Toronto (CA); Ian Bruce, Hamilton (CA); Jeff Bondy, Hamilton (CA); Laurel Trainor, Hamilton (CA); Ronald Jay Racine, Dundas (CA)

(73) Assignee: McMaster University, Hamilton (CA)

( * ) Notice: Subject to any disclaimer, the term of this patent is extended or adjusted under 35 U.S.C. 154(b) by 423 days.

(21) Appl. No.: 10/733,451

(22) Filed: Dec. 12, 2003

(65) Prior Publication Data

US 2005/0069162 A1 Mar. 31, 2005

Related U.S. Application Data

(60) Provisional application No. 60/504,961, filed on Sep. 23, 2003.

(51) Int. Cl.
*H04R 25/00* (2006.01)

(52) U.S. Cl. ..... 381/320; 381/314

(58) Field of Classification Search ..... 381/314, 381/320

See application file for complete search history.

(56) References Cited

U.S. PATENT DOCUMENTS

| | | | | |
|---|---|---|---|---|
| 4,366,349 | A | 12/1982 | Adelman | |
| 5,029,217 | A * | 7/1991 | Chabries et al. | 381/318 |
| 5,259,033 | A | 11/1993 | Goodings et al. | |
| 5,561,598 | A * | 10/1996 | Nowak et al. | 381/71.11 |
| 6,738,486 | B1 | 5/2004 | Kaulberg | |

FOREIGN PATENT DOCUMENTS

| | | | |
|---|---|---|---|
| CA | 2397009 | A1 | 8/2003 |
| WO | WO 95/08248 | A1 | 3/1995 |

OTHER PUBLICATIONS

Bia, A., "Alopex-B: A new, simpler but yet faster version of the Alopex training algorithm", International Journal of Neural Systems, Special Issue on Non-gradient optimisation methods, pp. 497-507, 2001.

Boudreaux-Bartels, G.F., Parks, T.W., "Time-Varying Filtering and Signal Estimation Using Wigner-Ville Distribution Synthesis Techniques", IEEE Trans. on Acoustic, Speech, and Signal-Processing, 34(3):442-451, Jun. 1986.

Bruce, I.C.; Sachs, M.B.; Young, E.D., "An auditory-periphery model of the effects of acoustic trauma on auditory nerve responses", JASA 113(1), Jan. 2003, pp. 369-388.

Campbell, D.R., "Binaural Sub-band adaptive noise cancellation—some results", University of Paisley, Scotland, UK; presentation.

(Continued)

*Primary Examiner*—Daniel Swerdlow
(74) *Attorney, Agent, or Firm*—Bereskin & Parr

(57) ABSTRACT

A system and method for processing an acoustic input signal and providing at least one output acoustic signal to a user of a hearing-aid system. The hearing-aid system includes first and second channels with one of the channels having an adaptive delay. The first channel includes a directional unit for receiving the acoustic input signal and providing a directional signal; a correlative unit for receiving the directional signal and providing a noise reduced signal by utilizing correlative measures for identifying a speech signal of interest in the directional signal; and, a compensator for receiving the noise reduced signal and providing a compensated signal for compensating for a hearing loss of the user.

35 Claims, 8 Drawing Sheets

OTHER PUBLICATIONS

Campbell, D.R. & Shields, P. "Improvements in intelligibility of noisy revererant speech using a binaural sub-band adaptive noise-cancellation processing scheme". Journal of the Acoustical Society of America, 110(6), 2001, pp. 3232-3242.
Campbell, D.R., "Sub-Band Adaptive Speech Enhancement for Hearing Aids", University of Paisley, Scotland, UK.
Doucet, De Freitas, Gordon (eds.) Sequential Monte Carlo methods in practice, Springer-Verlag, 2001, pp. 77-93.
Elledge, M.E., et al., "A real-time dual-microphone signal-processing system for hearing-aids", J. Acous. Soc. Am., 1999, 106 (Pt. 2): 2227-2282.
French, N.R., Steinerg, J.C., "Factors Governing the Intelligibility of Speech Sounds", 1947, JASA 19, 90-119.
Frost, O.L., "An algorithm for linearly constrained adaptive array processor" Proceedings of the IIE, vol. 60, Aug. 1972, 926-935.
Griffiths, L.J., Jim, C.W. "An alternative approach to linearly constrained adaptive beamforming", IEEE Transactions on Antennas and Propagation, AP-30, Jan. 1982, 27-34.
Greenberg, J.E., "Improved design of microphone-array hearing-aids", Ph.D. Thesis, 1994, MIT, Cambridge, MA, pp. 34-75, 141-187.
Haykin, S., "Kalman Filters", Chapter 10, Adaptive Filter Theory 4th Edition, Prentice Hall, 2002, pp. 466-495.
Heinz, M.G. et al., "Auditory nerve model for predicting performance limits of normal and impaired listeners", 2001, Acoustics Research Letters Online 2(3):91-96.
Heinz, M.G., et al., "Quantifying the implications of nonlinear cochlear tuning for auditory-filter estimates", 2002, J. Acoust. Soc. Am., 111, 996-1011.
Hoffman, M.W., Trine, T.D., Buckley, K.M., Van Tasell, D.J., "Robust adaptive microphone array processing for hearing aids: realistic speech enhancement", J Acoust Soc Am. Aug. 1994; 98 (2 Pt 1): 759-770.
Liberatore et al., "A new symbolic program package for the interactive design of analog circuits", ISCAS '95, IEEE International Symposium on Circuits and Systems, 1995, vol. 3 (IEEE, Piscataway, NJ), pp. 2209-2212.
Matthews, J.W., "Modeling reverse middle ear transmission of acoustic distortion signals," In Mechanics of Hearing: Proceedings of the IUTAM/ICA Symposium, edited by E. de Boer and M.A. Viergever, Delft U.P., Delft, pp. 11-18.
Michalewicz, Z., "Genetic Algorithms + Data Structures = Evolution Programs", Springer-Verlag, 1996, 3rd edition, pp. 57-79.
Nobili, R., & Mammano, F., "Biophysics of the cochlea II: Stationary nonlinear phenomenology", J. Acoust. Soc. Am., 1996, 99(4), Pt. 1, 2244-2255.
Peake, W.T., Rosowski, J.J., Lynch III, T.J., "Middle-ear transmission: Acoustic versus ossicular coupling in cat and human", 1992, Hear. Res., 57, 245-268.
Peterson, P.M., "Adaptive array processing for multiple microphone hearings-aids", Ph.D. Thesis, 1989, MIT, Cambridge, MA, pp. 37-55, 99-108.
Sachs, M.B. et al., Biological basis of hearing-aid design, (Center for Hearing Sciences and Department of Biomedical Engineering, Johns Hopkins University, Baltimore, MD, 21205, U.S.A.) Ann Biomed Eng 30 Feb. 2002, pp. 157-168.
Schwartz, O. and Simoncelli, E., Natural sound statistics and divisive normalization in the auditory system, Advances in Neural information Processing Systems 13, T.K. Leen, T.G. Dietterich and V. Tresp (eds), MIT Press, Cambridge, Ma 2001 pp. 1-7.
Soede, W., Berkhout, A.J., and Bilsen, F.A., "Development of a directional hearing instrument based on array technology"J. Acoust. Soc. Am. 94, 785 (1993).
Stern, R.M. and Sullivan, T.M., "Robust Speech Recognition Based On Human Binaural Perception", Carnegie Mellon University, Pittsburgh, Pennsylvania.
Sumner, CJ et al., "A revised model of the inner-hair cell and auditory nerve complex" J. Acoust. Soc.Am., 2002, 111 (5), Pt. 1. 2178-2188.
Tang, Z., et al., "Genetic Algorithms and their Applications", IEEE Signal Processing Magazine, pp. 22-37, Nov. 1996.
Unnikrishnan, K.P. and Venugopal, K.P., "Alopex: A correlation-based learning algorithm for feedforward and recurrent neural networks", Neural Computation, 6(3), May 1994.
Vanden Berghe, J. and Wouters, J., "An adaptive noise canceller for hearing aids using two nearby microphones", J. Acoust. Soc. Am. 103(6), Jun. 1998, pp. 3621-3626.
Zhang, X.; Heinz, M.G.; Bruce, I.C.; Carney, L.H., "A Phenomenological Model for the Responses of Auditory-Nerve Fibers: I. Nonlinear Tuning with Compression and Suppression", JASA 109(2), Feb. 2001, pp. 648-670.
Buus, S. "Loudness functions derived from measurements of temporal and spectral integration", in Auditory models and non-linear hearing aids ed. by A. N. Rasmussen, T. Poulsen, T. Andersen, and Osterhammel, GN ReSound, Tåstrup, Denmark, 1999, 135-188.

* cited by examiner

BINAURAL ADAPTIVE HEARING AID

FIELD OF THE INVENTION

The invention relates to a hearing-aid system. In particular, this invention relates to a hearing-aid system that re-establishes a near-normal neural representation in the auditory system of an individual with a sensorineural impairment.

BACKGROUND OF THE INVENTION

The human auditory system can detect quiet sounds while tolerating sounds a million times more intense, and it can discriminate time differences of a couple of microseconds. Even more amazing is the ability of the human auditory system to perform auditory scene analysis, whereby the auditory system computationally separates complex signals impinging on the ears into component sounds representing the outputs of different sound sources in the environment. However, with hearing loss the auditory source separation capability of the system breaks down, resulting in an inability to understand speech in noise. One manifestation of this situation is known as the "cocktail party problem" in which a hearing impaired person has difficulty understanding speech in a noisy room.

There have been several recent advances in understanding the neurophysiological basis of hearing impairment. The insight that damage to the hair cells within the inner ear alters the auditory system must have a profound effect on the design of hearing-aid systems to combat sensorineural hearing loss. However, current hearing-aid technology does not make full use of this information. Up until the mid 1980's, the mechanisms underlying the more prevalent types of impairment due to hair cell loss were not well understood. This led to a group of ad-hoc algorithms, largely based on the discerned symptoms (spectrally shaped sensitivity loss, identification in noise problems) as opposed to the mechanisms underlying the symptoms. Hearing-aid algorithms are still based on conductive impairment, which can arise after ossicle damage or an ear drum puncture, and can largely be overcome with frequency-shaped linear amplification. The types of impairment associated with sensorineural hearing loss (i.e. Inner Hair Cell (IHC) and Outer Hair Cell (OHC) damage) requires a new suite of algorithms. The loss of these hair cells produces symptoms such as elevated thresholds, loss of frequency selectivity, loss of contrast enhancement, and loss of temporal discrimination. This invention emphasizes a new suite of algorithms to deal specifically with sensorineural impairment.

SUMMARY OF THE INVENTION

Research in characterizing sensorineural hearing loss has delineated the importance of hair cell damage in understanding the bulk of sensorineural hearing impairments. This has led the inventors to develop a hearing-aid system that is based on restoring normal neural functioning after the sensorineural impairment, while relying on the intact processing in the central (subcortical and cortical) auditory system, by using neurophysiologically based models of the auditory periphery. Accordingly, machine learning is used to train a compensator module to pre-warp an input acoustic signal in an optimal way, such that after transduction through the damaged auditory model, the resulting signal is similar to that produced by a normal model of the auditory periphery. The hearing-aid system also includes a correlative unit based on phoneme identification for noise reduction and speech enhancement prior to the processing done by the compensator. The hearing-aid system preferably relies on binaural processing of the input acoustic signal by incorporating the compensator and correlative unit in at least one of the auditory pathways of the hearing impaired person and tuning the correlative unit and the compensator in a binaural fashion. This includes an adaptive delay in one of the auditory pathways so that the resulting neural signals can be processed at the auditory cortex in a synchronous fashion. It also includes directional processing.

In a first aspect, the present invention provides a hearing-aid system for processing an acoustic input signal and providing at least one output acoustic signal to a user of the hearing-aid system. The hearing-aid system comprises a first channel and a second channel. One of the channels includes an adaptive delay. The first channel includes a first directional unit for receiving the acoustic input signal and providing a first directional signal; a first correlative unit coupled to the first directional unit for receiving the first directional signal and providing a first noise reduced signal by utilizing correlative measures for identifying a speech signal of interest in the first directional signal; and, a first compensator coupled to the first correlative unit for receiving the first noise reduced signal and providing a first compensated signal for compensating for a hearing loss of the user.

In a second aspect, the present invention provides a noise reduction unit for use in a hearing aid. The noise reduction unit receives an input signal and provides a noise reduced signal. The noise reduction unit includes a correlative portion for providing correlative measures for identifying a speech signal of interest in the input signal and a tracking portion for tracking the speech signal of interest to produce the noise reduced signal.

In another aspect, the present invention provides a compensator for compensating for hearing loss in a hearing-aid. The compensator comprises a normal hearing model unit for receiving an input signal and generating a normal hearing signal; a neuro-compensator unit for receiving the input signal and providing a pre-processed signal by applying a set of weights to the input signal; a damaged hearing model unit connected to the neuro-compensator unit for receiving the pre-processed signal and providing an impaired hearing signal; and, a comparison unit connected to the normal hearing model unit and the damaged hearing model unit for generating an error signal based on a comparison of the normal hearing signal and the impaired hearing signal. The error signal is provided to the neuro-compensator unit for adjusting the set of weights such that the normal hearing signal and the impaired hearing signal are substantially similar.

In another aspect, the present invention provides a method of processing an acoustic input signal and providing at least one output acoustic signal to a user of a hearing-aid system. The method provides a first channel and a second channel, wherein one of channels includes an adaptive delay. For the first channel, the method comprises:

a) providing directional processing to the acoustic input signal for generating a first directional signal;

b) processing the first directional signal for providing a first noise reduced signal by utilizing correlative measures for identifying a speech signal of interest in the first directional signal; and, c) processing the first noise reduced signal for providing a first compensated signal for compensating for a hearing loss of the user.

In another aspect, the present invention provides a method of reducing noise in an input signal and generating a noise reduced signal for a hearing aid. The method comprises:

a) generating correlative measures for identifying a speech signal of interest in the input signal; and, b) tracking the speech signal of interest to produce the noise reduced signal.

In another aspect, the present invention provides a compensation-based method for hearing loss in a hearing-aid. The method comprises:

a) receiving an input signal and generating a normal hearing signal based on a normal hearing model;

b) receiving the input signal and providing a pre-processed signal by applying a set of weights to the input signal;

c) receiving the pre-processed signal and providing an impaired hearing signal based on an impaired hearing model; and, d) generating an error signal based on a comparison of the normal hearing signal and the impaired hearing signal; The error signal is used to adjust the set of weights such that the normal hearing signal and the impaired hearing signal are substantially similar.

BRIEF DESCRIPTION OF THE DRAWINGS

For a better understanding of the present invention and to show more clearly how it may be carried into effect, reference will now be made, by way of example only, to the accompanying drawings which show a preferred embodiment of the present invention and in which.

DETAILED DESCRIPTION OF THE INVENTION

The auditory system of a hearing-impaired person is viewed as an impaired dual communication channel. The dual communication channel begins with some acoustic information source, goes through a multipath channel and is received at the two ears. The signals are processed by the auditory periphery before being coded into a neural representation and being passed to the central auditory system. The two signals go through the left and right auditory midbrain (cochlear nucleus, superior olive, inferior colliculus and medial geniculate body) to the auditory cortex and higher association areas, where they are integrated, resulting in perception. Accordingly, the dual channels correspond to the left and right auditory periphery and central channels of the hearing impaired person. There are three possibilities since either one or both of these channels may be damaged. In addition, the channels may be damaged in different ways (i.e. to a different extent and in different frequency regions). Although at least one channel corresponding to the peripheral auditory system is impaired, in most cases the central auditory system is still functioning correctly. Accordingly, the inventors have realized that signals in the two communication channels may be pre-processed to compensate for the hearing impairment in the corresponding auditory periphery channel and to take advantage of the processing that occurs in the central auditory system. Irrespective of the environment in which the hearing impaired person is located, the hearing-aid system corrects for the hearing impaired person's particular profile of hearing loss.

An individual's speech signal has the properties of temporal coherence (i.e. the features of the current spoken word follow from those of the previously spoken word) as well as redundancy. Accordingly, the inventors have realized that there is probabilistic continuity in the speech signal that can be used to distinguish it from background noise and that features can be identified in the speech signal that are more easily identified by accentuating the continuity.

The inventors have also realized the advantages of using the binaural processing of the auditory system. In particular, a hearing-aid system that is binaural will add directional information about the source of incoming sounds. This can make a significant contribution to audibility and separation of simultaneous sounds by providing a mechanism for attention. This also allows for exploiting the processing that is done by the central auditory system which correlates signals received by the left and right auditory peripheral channels. Furthermore, by combining the signals received from the two auditory periphery channels, speech reception thresholds are significantly improved over those seen in monaural listening.

Figure 1:
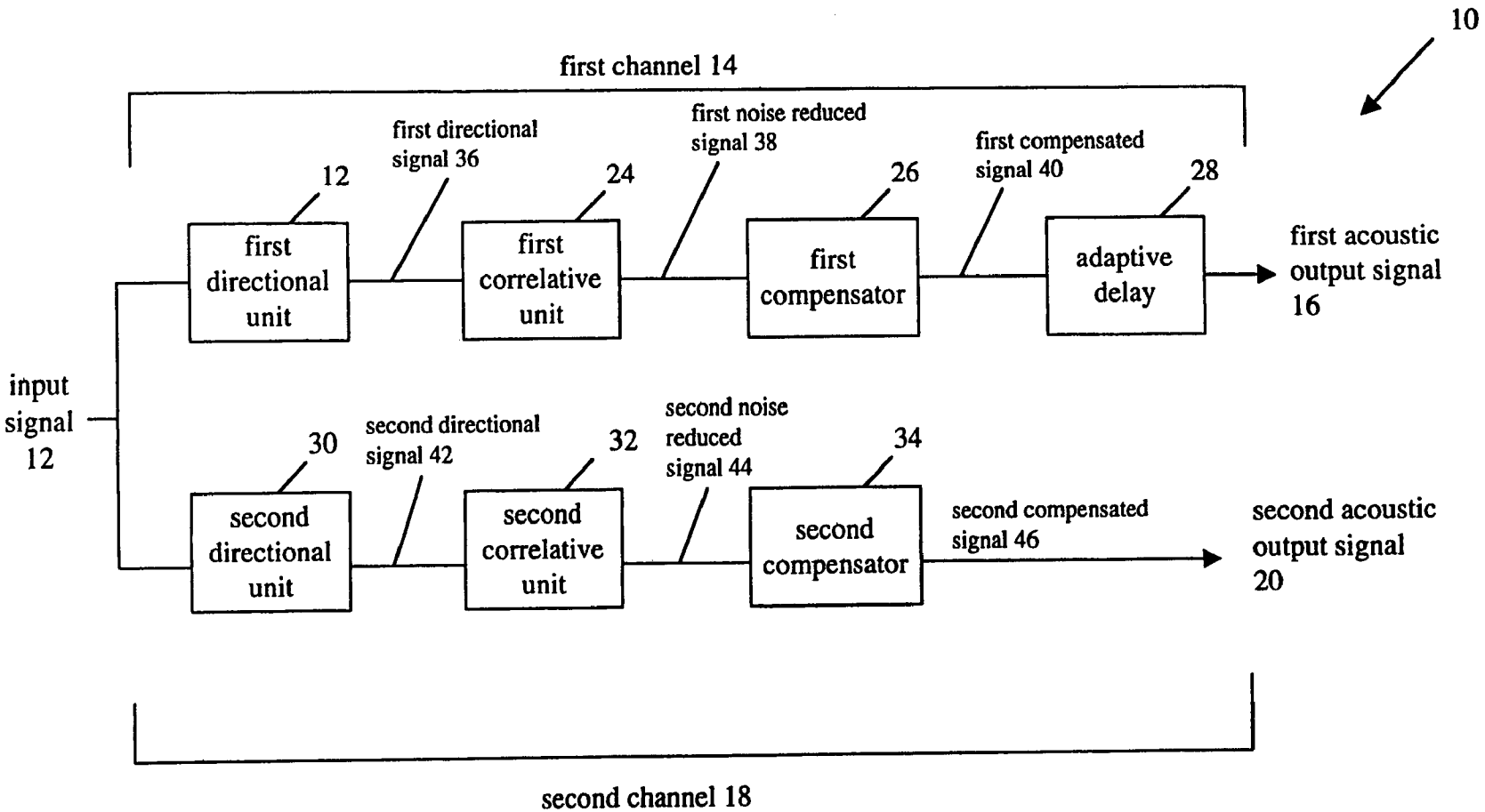
FIG. 1 is a block diagram of a hearing-aid system in accordance with the present invention.

Referring first to FIG. 1, shown therein is a block diagram of an exemplary embodiment of a binaural adaptive hearing-aid system 10 in accordance with the present invention. The hearing-aid system 10 processes an acoustic input signal 12 with a first channel 14 to produce a first acoustic output signal 16 and a second channel 18 to produce a second acoustic output signal 20. The acoustic input signal 12 typically contains speech, or some other information signal, as well as background noise. The acoustic output signal 16 is provided to one ear of a hearing impaired person and the acoustic output signal 20 is provided to the other ear. The first and second channels 14 and 18 can be implemented in separate behind-the-ear or in-the-ear hearing-aid units. Alternatively, the first and second channels 14 and 18 can be implemented in the same unit, which can be worn on the body (e.g. attached to a belt), in which the first and second acoustic output signals 16 and 20 are provided to separate ears via separate means such as two cables with miniature speakers, bone conduction transducers, telecoils, RF transceivers and the like.

In general, both the first and second channels 14 and 18 have the same components with one of the channels further including an adaptive delay element. In this embodiment, the first channel 14 includes a first directional unit 22, a first correlative unit 24, a first compensator 26 and an adaptive delay unit 28 (not shown in FIG. 1). The second channel 16 includes a second directional unit 30, a second correlative unit 32, and a second compensator 34. Alternatively, the adaptive delay unit 28 can be placed in the second channel 18 rather than the first channel 14. It will be apparent to those well versed in the methodology of hearing-aid design that additional conventional processing elements must be included in the first and second channels 14 and 16 such as analog-to-digital converters (between the directional units 22 and 30 and the correlative units 24 and 32) and digital-to-analog converters (after the adaptive delay unit 28 and the second compensator 34).

The first directional unit 22 processes the acoustic input signal 12 to provide a first directional signal 36. Directional processing provides a first level of noise filtering since the first directional unit 22 allows the hearing-aid system 10 to focus or tune in to acoustic signals coming from a certain direction and ignore other acoustic signals (i.e. to enhance the attentional capability of the hearing-aid system 10). The first correlative unit 24 then processes the first directional signal 36 to produce a first noise-reduced signal 38. The first correlative unit 24 processes the first directional signal 36 to preferably stream speech contained in the acoustic input signal 12 and to extract the speech and therefore further reduce noise. The compensator 26 then processes the first noise-reduced signal 38 to produce a first compensated signal 40. The compensator 26 is designed to compensate for the severity of the hearing loss in the ear to which the first acoustic output signal 16 is provided. The first compensated signal 40 is then delayed by the adaptive delay unit 28 to produce the first acoustic output signal 16. The elements of the second channel 18 operate in a similar fashion to those in the first channel 14 to produce a second directional signal 42, a second noise-reduced signal 44 and a second compensated signal 46. However, the second compensator 34 is designed to compensate for the hearing loss in the ear to which the second acoustic output signal 20 is provided.

In this case, the second acoustic signal 20 corresponds to the second compensated signal 46 and is provided to the other ear of the hearing impaired individual that is using the hearing-aid system 10. The delay of the adaptive delay unit 28 is such that the delay in processing in the first and second channels 14 and 18 are similar such that the first and second acoustic output signals 16 and 20 retain a correlated relationship to one another. This allows the hearing-aid system 10 to take advantage of the correlative processing that is performed by the central auditory system to aid the hearing impaired person in understanding the speech in the acoustic input signal 12. Therefore, the delay is used to ensure that the first and second acoustic output signals 16 and 20 reach the auditory cortex in proper synchrony.

The hearing-aid system 10 preferably utilizes parallel computation in the two channels 14 and 18 with the objective of minimizing the processing delay through the whole system. This allows the user of the hearing-aid system 10 to realize satisfactory perception of incoming speech signals and to maintain synchrony between the auditory and visual paths, and thereby maintain the capability of the hearing impaired person to exploit lip-reading while processing acoustic signals to achieve a solution to the cocktail-party problem.

The first and second directional units 22 and 30 may be any suitable beamformer. The primary purpose of the first and second directional units 22 and 30 is to provide spatial filtering to reduce noise and interference. The idea is to group all components of sound that come from the same position in space since they are likely to have been created by the same source. In particular, the signal strength of a speech or information signal in a particular spatial location is augmented while competing spatial locations are taken as noise and reduced. This increases intelligibility and reduces the stress that is normally associated with noisy listening conditions.

The first and second directional units 22 and 30 may be non-adaptive beamformers, such as delay-and-sum beamformers, which includes time-domain delay-and-sum beamformers and sub-band (i.e. frequency domain) phase-shift-and-sum beamformers. Alternatively, adaptive beamformers may be used, such as the Minimum-Variance Distortionless Response (MVDR) beamformer, the Griffiths-Jim beamformer (Griffiths, L. J., Jim, C. W. 1982, "An alternative approach to linearly constrained adaptive beamforming". IEEE Transactions on Antennas and Propagation, AP-30, January 1982, 27–34), the Frost beamformer (Frost, O. L., 1972, "An algorithm for linearly constrained adaptive array processor". Proceedings of the IIE, vol. 60, August 1972, 926–935) and the Generalized Sidelobe Canceller (GSC) beamformer (Haykin, S, Adaptive Filter Theory $4^{th}$ Edition, Prentice Hall, 2002). Yet another alternative is to use both non-adaptive and adaptive binaural beamformers, such as the Frequency-band Minimum Variance (FMV) beamformer (Elledge, M. E., Lockwood, M. E., Bilger, R. C., Feng, A. S., Goueygou, M., Jones, D. L., Lansing, C. R., Liu, C., O'Brien, W. D. Jr., Wheeler, B. C., 1999, A real-time dual-microphone signal-processing system for hearing-aids J. Acous. Soc. Am., 106 (Pt. 2): 2279A).

Other examples of suitable beamformers include those developed by Peterson (Peterson, P. M., 1989, "Adaptive array processing for multiple microphone hearing-aids," Ph.D. Thesis, MIT, Cambridge, Mass.), Soede (Soede, W. 1990, "Improvement of speech intelligibility in noise," Ph.D. Thesis, Delft University of Technology.), Hoffman (Hoffman, M. W., 1992, "Robust microphone array processing for speech enhancement in hearing-aids," Ph.D. Thesis, University of Minnesota) and Greenberg (Greenberg, J. E., 1994, "Improved design of microphone-array hearing-aids," Ph.D. Thesis, MIT, Cambridge, Mass.) Soede focuses on solving for the array configuration that produces the most directivity, and hence provides the most acute spatial filtering, while remaining time-invariant. Greenberg, Peterson, and Hoffman all use some form of the Frost beamformer. All of the beamformers that are mentioned are well known to those skilled in the art.

The first and second correlative units 24 and 32 are used to recognize features in the acoustic input signal 12 that correspond to a speech signal of interest in order to remove from the speech signal the background noise. In particular, the correlative units 24 and 32 utilize a form of Individualized Phonemic Processing (IPP) by identifying possible acoustic correlates in a speech stream and processing the correlates to provide further noise reduction. This form of processing is beneficial since different phonemes subjected to the same background distortion have their intelligibility reduced by different amounts. Hence, different processing is preferably applied on a per phoneme basis to increase intelligibility optimally. A further important addition for the hearing-aid system 10 is the use of streaming. Streaming is accomplished by the human listener by segregating and grouping together related elements that are part of the same speech or other acoustic source, based on the continuity in elemental acoustic events. Various acoustic cues, such as formant positions, frequency sweeps, and spectro-temporal grouping of onsets, can be used to identify and group together allophones produced by the same speaker. Allophones of a phoneme are the different realizations of the same phoneme, such as all the different ways of saying 'ph' and 'f' sounds that are determined to belong to the phoneme. A phoneme is the smallest unit of speech that is separately perceived, and treated as a distinct symbol (i.e. the umbrella grouping of the allophones). People pronounce phonemes differently and identifying these different acoustic events allows for segregation. Also, two speech streams have a different sequential time-transition structure, allowing for inferential processing to segregate these streams from one another. Not only do different speakers elicit a different inference pattern, but so do typical noise sources, such as wind or traffic. Accordingly, streaming can be used to distinguish a particular individual's speech signal from background noise or another person's speech.

Two processing strategies may be used for IPP. The first strategy attempts to characterize the acoustic correlate set as an analytic basis function, onto which the acoustic input signal 12 can be represented. Ideally the location of the projection into the space defined by the acoustic correlate set should occupy an isolated region for each phoneme. Processing is then done by shifting this projection towards the mean of the phoneme region by a distance determined by the confidence in the phonemic category. This processing scheme is based on a dictionary search. The projection is done through Atomic Decomposition Phonemic Processing (ADPP) which is discussed in more detail below.

The second strategy is referred to as Acoustic Correlate Tracking (ACT). The strength of this processing scheme is that a closed form, analytic, correlate function is not necessary. The ACT strategy of the present invention uses a large set of possible correlates to produce an over-complete representation to identify phonemes. These acoustic cues are not statistically independent, that is the joint probability is not a product of the individual event probability. For different phonemes the classification given the set of acoustic cues (the posterior distribution of classification) is inferred by training. This would be the base Automatic Speech Recognition (ASR) model, where classification is a function of Bayesian inference from training. The novelty is the use of a high dimensional representation to allow for segregation, as any suitably sparse representation will allow for segregation. Another large difference between ACT and ASR is the lack of a language model in ACT. Future acoustic event prediction is based on a Bayesian inference of the segregated streams of speech. In short, the inference connections at one time are used to classify a phoneme, inferential connections across time, are used to stream different sources, and improve phonemic classification, while the sparse, high-dimensional acoustic set provides robustness and segregation. The many inferential connections between correlates is used to predict the future frame representation, thus reducing the search space and eliminating the need for a language model typical of most speech recognition strategies. Hearing-aid processing is constrained to introduce no more than a 10 ms delay to keep the auditory signal in synchrony with bone conduction and visual cues. Thus, there is insufficient processing time to simulate a detailed language model. Also, the ACT strategy discards the dictionary that is required in ADPP, but adds in a highly over-complete frame and uses the time structure of the change in bases to assess various phonemic families. The ACT strategy highlights the acoustic cues that give the highest probability of speech recognition. Accordingly, the ACT processing strategy diminishes the contribution of low probability correlates. The ACT processing strategy is discussed in more detail below.

The ADPP processing strategy is suited for the different components of speech and adapts to suit the current circumstances or acoustic environment. The ADPP processing strategy involves using an analytic representation for speech based on acoustic correlates, with the same functionality as a time-frequency representation to create a "speech space". The new multidimensional representation includes the time-frequency plane and adaptively warps to fit the speech signal in a compact form. This compact form corresponds closely with the acoustic correlates. Thus, by studying the multidimensional representation one can ascertain which phonemic group is being represented, as well as applying a generalized set of time-frequency filtering techniques. The process followed is Pursuit Matching with a new five dimensional kernel, suited to speech, and a new cost function that is based on perceptual criteria and compactness of support.

ADPP uses a feature space for individual phonemes with physically meaningful dimensions. ADPP transforms the acoustic input signal 12 to the feature space via a kernel. The kernel is an analytic function that generates atoms which have a time representation that is sinusoidal in nature. An intuitive example of a physically meaningful feature space is a spectrogram, since moving along one dimension gives discrimination in cycles per second while moving along another dimension gives discrimination in time. The acoustic correlates that were found to produce a mathematically tractable feature space for ADPP processing include the following statistics: duration in time ($\sigma_T$), duration in frequency ($\sigma_F$), temporal centers of gravity ($T_c$), spectral centers of gravity ($F_c$), and change of temporal-spectral centers of gravity ($\beta$). The analytic kernel based on these correlates is defined below in equation 6. This is a two dimensional gaussian kernel, which allows for correlation between the two axes (in time and frequency). The center of the 2-D gaussian is located at ($T_c$, $F_c$), the spread of the gaussian determines the extent in time ($\sigma_T$) and frequency ($\sigma_F$), larger values correspond to longer durations or frequency spread, while the $\beta$ parameter corresponds to the chirp of the kernel.

The proposed kernel decouples the time-frequency variance terms without violating the Nyquist Rate. In addition, transitional cues, such as frequency sweeps, are very important acoustic correlates. In fact, rates of change in the second and third formant are major predictors of phoneme type. These signal sweeps are very close to chirped signals from the communications and radar literature. The kernel is then based on Time-Frequency plane design, with the time series derived through the Wigner-Ville Decomposition. The kernels are not necessarily orthogonal, meaning that this structure does not represent a basis. As such, it loses some physical meaningfulness. However, this can be averted by using a greedy matching pursuit algorithm that sequentially determines the atoms and removes the signal represented by previous atoms. In this way, energy is conserved, and dimensional linearity is retained.

Adaptive approximation techniques build an expansion adapted to the acoustic input signal 12. In these cases, the elements of the expansion are picked from an over-complete set. Adaptive approximation techniques include Atomic decomposition (AD) which is also known as matching pursuit or adaptive Gabor representation. AD computational complexity is set by the size of the dictionary. While some implementations are very inexpensive, some may have prohibitive computational constraints. In this case, AD provides a flexible, affordable and physically meaningful representation of a wide variety of signals. In AD, the set of all possible individual functionals of the over-complete set is called a dictionary with elements called atoms that have unit energy. AD searches for the atom that best approximates an input signal, removes the atom from the acoustic input signal 12, and then iterates. In a mathematical formulation, let s(t) be a signal (analogous to the input signal 12) in the finite energy signal space $L^2(R)$, and $D=\{h_\gamma(t)\}$ a dictionary. AD builds an approximation of s(t) according to equation 1:

$$s(t) = \sum_p b_p h_{\gamma_p}(t),\ p = 1, 2, \ldots \tag{1}$$

whose elements are iteratively computed according to equation 2:

$$\gamma_p = \text{argmax}\gamma |\langle s_{p-1}(t), h_\gamma(t)\rangle|^2, \text{ and } b_p = \langle s_{p-1}(t), h_{\gamma_p}(t)\rangle. \tag{2}$$

where $s_p(t)$ is called the $p^{th}$ residual and is defined according to equation 3:

$$s_p(t) = s_{p-1}(t) - b_p h_{\gamma_p}(t),\ p=1,2, \ldots,\ s_0(t)=s(t). \tag{3}$$

The approximation of s(t) is convergent if the dictionary D is complete. The variable γ is a vector of parameters defining each atom. Usually, the convergence issue is proved for the continuous-time case and is carried to the discrete-time domain assuming time-limited, band-limited signals. Additionally, a cross-term free time-frequency representation can be defined from AD. The so-called Adaptive Spectrogram (AS) is defined as:

$$AS_s = \sum_p |b_p|^2 W_{h_{\gamma_p}} \tag{4}$$

where $W_X$ means the Wigner-Ville distribution of signal x(t). The AS is the inverse representation of the Atomic Decomposition, or how one would re-assemble the signal from it's constituent atoms.

Since the AD cost function is an inner product, AD extracts those signal components that are coherent, i.e. correlated, with the atoms of the dictionary. Therefore, the selection of the dictionary becomes an important issue that will depend on the type of signal to be represented and the type of features that are to be identified. Traditionally, three types of dictionaries, which are well known to those skilled in the art, have been used: Gabor functions, wavelet packets and chirplets. Gabor functions have been used because of their optimum concentration in time and frequency. They are defined as translations, modulations and scalings of the Gaussian window: $h(t)=\sqrt[4]{2}e^{-\pi t^2}$. Therefore, they are defined by means of three parameters: mean time, mean frequency and duration. Wavelet packets arise from the generalization of the multi-resolution approximation. Each packet contains a number of bases that tile the time-frequency domain in a different way. For each atom, we can associate three parameters: mean time, mean frequency and scale (or duration). Wavelet packets may be more advantageous due to the existence of a fast and efficient algorithm to compute the inner products among the atoms of the wavelet packet and the signal.

The Gabor dictionary is much more redundant than a typical wavelet packet dictionary. Thus, it may achieve a more parsimonious representation of the input signal by following greedy matching pursuit because dependant atoms are discarded. However, the search for the most correlated atom is much easier and more efficient using wavelet packets. That is, in the discrete implementation, with N being the length of the signals, a wavelet packet dictionary has $N \cdot \log_2 N$ components, while a Gabor dictionary will have an infinite number of components. Both dictionaries have the inherent limitation that they are not able to compactly approximate a signal with a chirp. For this reason, a chirplet dictionary may be appropriate. Chirplets are Gabor functions with a certain chirp rate. Each chirplet is defined as:

$$h_\gamma(t) = \sqrt[4]{\frac{\alpha}{\pi}}\, e^{-\frac{\alpha}{2}(t-T)^2}\, e^{j[2\pi f(t-T)+\pi\beta(t-T)^2]}, \tag{5}$$

where γ is the four-component vector $\gamma=[\alpha,\beta,T,f]^T$. The parameters T, f and β are the chirplet mean time, mean frequency, and chirp rate, respectively and the parameter α is inversely related to the duration of the chirplet. Gabor functions are a special subset of the chirplet dictionary. Like Gabor functions, chirplets offer time-frequency concentration and give rise to a positive adaptive spectrogram with optimum time-frequency resolution.

It is desirable to decouple both time and frequency spreading in the time-frequency representation of the atoms to build a dictionary capable of representing the time-frequency structures that are observed in speech. Synthesis algorithms can be used to estimate the signal whose time-frequency representation is closest to the desired representation. The analytic function that maps the dimensions of duration in time, duration in frequency, temporal centers of gravity, spectral centers of gravity, and change of spectral centers of gravity is:

$$h_{T_c,F_c,\sigma_T,\sigma_F,\beta}(t, f) = \frac{1}{2\pi\sigma_T^2\sigma_F^2} e^{-\left[\frac{1}{2(1-\beta^2)}\left(\frac{(t-T_c)^2}{\sigma_T^2} - \frac{2\beta(t-T_c)(f-F_c)}{\sigma_T\sigma_F} + \frac{(f-F_c)^2}{\sigma_F^2}\right)\right]} \tag{6}$$

Figure 3:
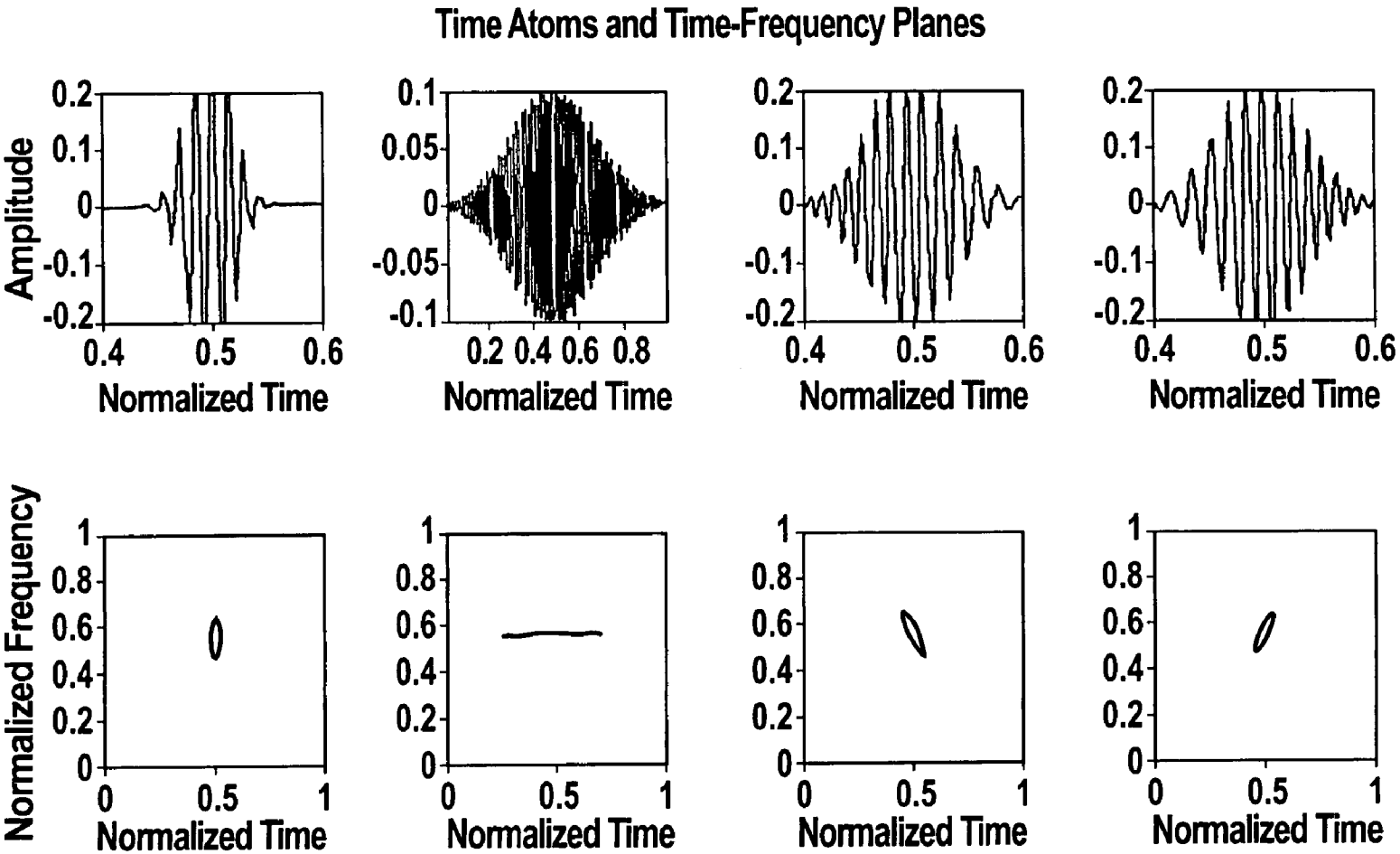
FIG. 3 is a series of graphs showing time atoms with associated time-frequency planes for atoms that are used in the Atomic Decomposition Phonemic Processing scheme.

The 5-D analytic function in equation 6 does not have a closed form, time domain representation, because of the independence of the time and frequency spread. Equation 6 is a new analytic function that extends the chirplet family, and was necessary for the health function of the genetic algorithm described below. To produce a time atom one must resort to maximum likelihood design procedures. The Wigner Distribution Synthesis techniques from Boudreaux-Bartels and Parks are used to produce a time atom because of the useful properties of this technique which gives rise to time series atoms typified by FIG. 3. These time atoms are applied in pursuit matching to calculate the health of the atom; one can see that they are localized in time and frequency. The Wigner-Ville Decomposition (WVD) is a correlative approach to calculate a time series from a magnitude-square (positive spectrum) representation. Any spectral-root transform can be used. The Wigner-Ville was found to be sufficient for this application. FIG. 3 gives an example of the atoms used. Each atom has the magnitude-squared spectrum and the corresponding time kernel. The parameters show differences in the base attributes (i.e. the 5-D representation). The inventors have decided to make a time-frequency representation that provides the best signal in the least squares sense for a given Wigner-Ville distribution.

The time-frequency representation is computed according to equation 6 and WVD synthesis is applied. (Boudreaux-Bartels, G. F., Parks, T. W., "Time-Varying Filtering and Signal Estimation Using Wigner-Ville Distribution Synthesis Techniques", IEEE Trans. on Acoustic, Speech, and Signal-Processing, 34(3):442–451, June 1986).

One important issue in AD is the suitable selection of the optimization procedure in which the search space of the optimization procedure is actually the parameter space of the 5-D analytical function. The optimization procedure has to be carefully chosen because of the extremely complex structure of the objective function, with multiple local optima coming from the existence of noise and multi-component signals, and domain regions where it is nearly constant. Therefore, global search algorithms refined by descent techniques are the most suitable strategies.

Figure 2:
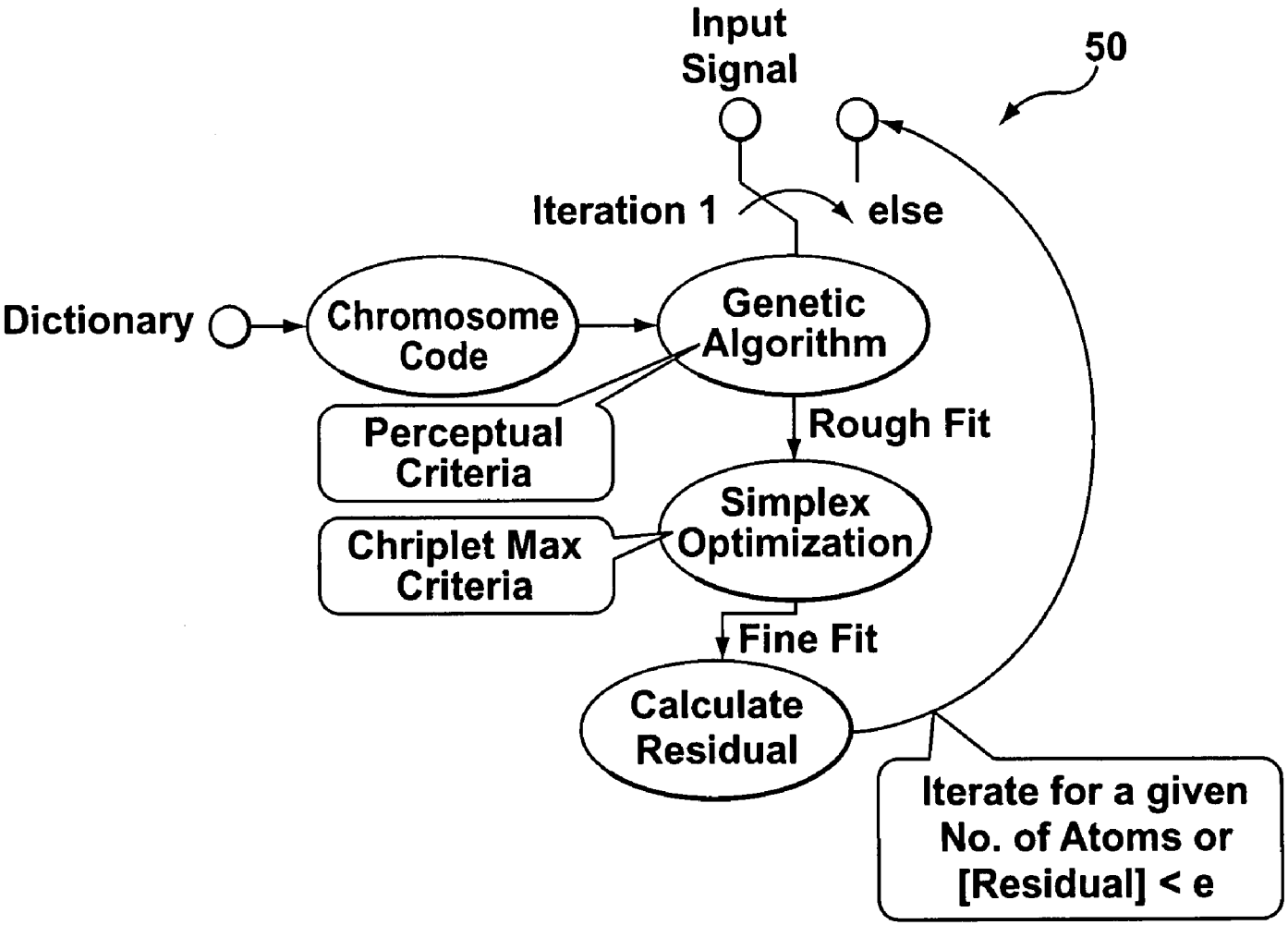
FIG. 2 (PRIOR ART)
FIG. 2 is a block diagram of an Atomic Decomposition Phonemic Processing scheme.

The AD strategy of the present invention uses a genetic algorithm (GA) refined with a quasi-Newton search. In particular, the GA is the haploid algorithm, with binary implementation, random mating, and simple selection as the sampling procedure which is known to those skilled in the art (Michalewicz, Z., "Genetic Algorithms+Data Structures=Evolution Programs", Springer-Verlag, 1996, 3rd edition; Tang, Z., Man, K. F., Kwong, S., He, Q., "Genetic Algorithms and their Applications", IEEE Signal Processing Magazine, pages 22–37, November 1996). GA complexity is linear with regard to the number of samples in the input signal. It performs a probabilistic search in the domain space. A single point crossover and a bit-by-bit mutation are also performed with a given probability of crossover and mutation respectively. A flowchart of the AD processing strategy 50 is shown in FIG. 2. Here the input signal is windowed and input into the greedy GA algorithm. The GA is seeded with a random population of dictionary elements, and several birth and death cycles are carried out, with healthier populations being defined by their correlative fit along with their spectro-temporal integration size. The atom deemed healthiest is then fine tuned with a Newton optimization in the Simplex step. This optimum atom is then subtracted off the input signal, and the steps from the GA down is repeated many times to get a set of atoms from one time windowed input sample. The number of iterations is a tradeoff between accuracy of classification and running time. After four atoms per time slice, the accuracy does not improve very much, while running time increases linearly. The inventors used between 3 and 10 atoms with four to six atoms being preferable.

Correlation is used to calculate how well a particular atom fits the input signal. The idea is to choose the atom h with coefficients $T_c$, $F_c$, $\sigma_T$, $\sigma_F$ and $\beta$ that produce the maximal correlation to the input signal s(t). However, straight correlation is not necessarily an accurate measure of perceptual importance. Accordingly, the inventors propose the following perceptual criteria:

$$\gamma_P = \arg\max_{\gamma} |\langle s_{P-1}(t), f(\sigma_T, \sigma_F) h_\gamma(t)\rangle|^2 \tag{7}$$

where $f(\sigma_T, \sigma_F)$ is a novel integration of loudness perception function, that is a two-dimensional saturating exponential growth function of spectral and temporal extent. This mimics the auditory system's growth of loudness curves. In this way, ADPP controls for the effect of the size or duration of the input signal, picking the perceptually loudest atom. The temporal growth of the loudness perception function is a well-defined mapped function (Soren Buss, "Spectral-Temporal Integration of Loudness") and the frequency growth is chosen to mirror the temporal growth. The argmax( ) function takes the $\gamma$ kernel with the largest correlation to the input signal s(t). The atoms used here are made to highlight longer duration elements, saturating near 8 ms, because transients are discarded in the brain if they are too quick, unless they are spectrally wideband. The perceptual criterion is used to look for the closest ideal phoneme that corresponds to the input signal that is being analyzed.

In an alternative to ADPP processing, the correlative units 24 and 32 may use Acoustic Correlate Tracking (ACT) to identify the phonemes in speech contained in the acoustic input signal 12 as well as provide compression for the noise-reduced signals 38 and 44. The ACT processing scheme uses feature extraction and tracking to filter the speech signal of interest from the background noise in the acoustic input signal 12. Tracking is based on the fact that the continuity of a speech signal is different from that of background noise as well as other, independent speech streams. Accordingly, the ACT processing scheme computes correlative measures to identify features in the acoustic input signal 12 related to a speech signal and tracks these features as they move through time and frequency. These features can be identified by using principal component analysis (PCA), the chirplet frame, nonlinear basis identification (such as trained Neural Networks) or any acoustic or statistically significant identifier. Examples of some features are shown in Table 1 (this is not an exhaustive list; many other features can be used). The inventors prefer to use a heuristically defined set of features, as this gives the largest applicability. For example, PCA can be used in conjunction with zero-crossings and formant identification to come up with a conglomerate set of heuristic identifiers which do well at identifying steady state noises, as well as voiced-speech. Increasing this heuristic set of features adds to what sound sources can be described. Tracking can be done by using the Kalman filter, Particle Filtering, Bayesian inference, empirical heuristics or any other inference engine. The inventors have found that it is preferable to use particle filtering to track and predict state changes. The features can first be extracted and then tracking may be done in a two-step procedure. Alternatively, the extraction and tracking can be done at the same time which may be more efficient, because correlations across previous time instants can be projected forward as acoustic cues in their own right. This is analogous to using the Kalman predictor to identify a state and then that state has a direct impact on the estimation given a new measurement. The predictive structure of the tracker is then an acoustic event in of itself.

Figure 4A:
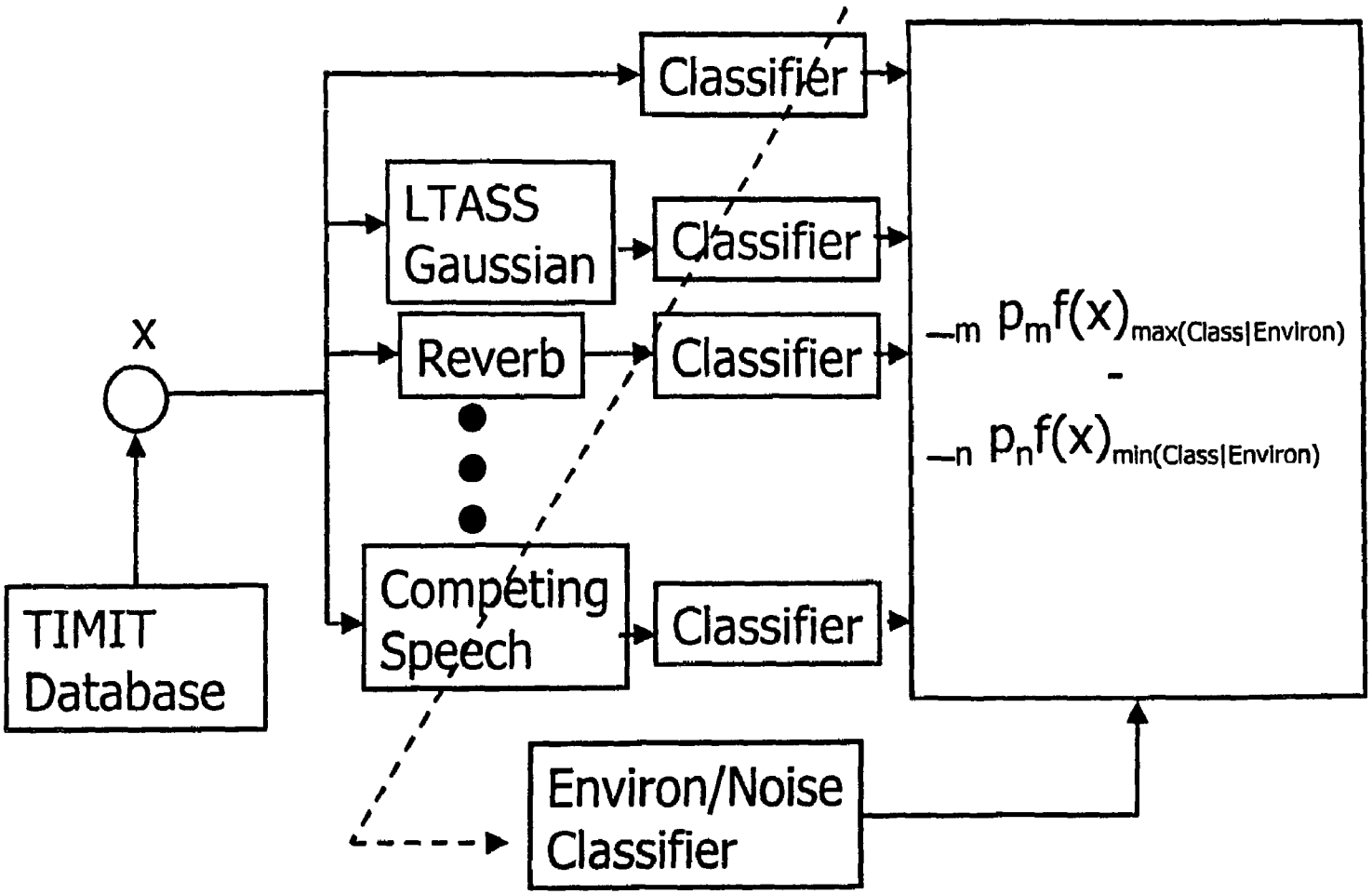
FIG. 4*a* is a block diagram illustrating training for an Acoustic Correlative unit.

ACT is trained to adapt to environmental and source changes. The training procedure is shown in FIG. 4*a*. The TIMIT database may be used to provide training signals. However, any other phonemically labeled database can be used, such as the R-HINT-E database. Through various channel conditions such as additive Long Term Average Speech Spectrum (LTASS) Gaussian noise, reverberation and competing speech, the posterior distributions are designed. The Classifiers are high dimensional sets of acoustic correlates (or features), and the Environmental and Noise classifier makes use of the classifier distributions to identify the conditions affecting the acoustic correlates. The environmental classifier then adapts the final processing strategy depending upon the present conditions (modified by past condition because of inferential memory in the classifier) before output into the next block of the hearing-aid system.

The first step in the ACT process is the accumulation of the statistical distributions of the feature extractors by passing a phonemically marked training set through the feature extractors to train for phonemic recognition. An example training set used is the phonemically labeled TIMIT database in two modes, one with every speaker combined, and another with each speaker producing their own phonemic recognizer. The predictive confidence of phonemic classification then depends on the distribution of all the feature extractors, or "experts". This is used to drive the reconstruction at the output of the correlative unit 24 or 32.

The ACT processing scheme utilizes a variety of correlates of various dimensions to identify phonemes in the acoustic input signal 12. A typical, abridged set of correlates is summarized in Table 1. The ACT processing scheme does not rely on an analytic function. Rather the most informative correlates are identified depending on the particular acoustic environment (some of the correlates are used solely to determine information about the environment). Here it is important that the training successfully captures the statistical posterior distributions of each correlate given noise, environment given correlate set, phoneme given environment and correlate set etc.

TABLE 1

Sample ACT Correlate Set

| Features | Dimensionality |
|---|---|
| Linear Prediction Coefficients | 19 |
| Auto-Correlation Coefficients | 20 |
| Reflection Coefficients | 20 |
| Cepstrum Coefficients | 19 |
| Prediction Error | 1 |
| Formants and Bandwidths | 4, 4 |
| Normalized Energy | 1 |
| First Order Zero Crossings | 1 |
| Second Order Zero Crossings | 1 |
| Poles of the Transfer Function | 4 |
| Interband Modulation Rate | 8 |
| Chirp Rate | 4 |
| Mixture of Polynomials | 10 |
| Mixture of Gaussians | 8 |
| Temporal Onset | 8 |
| 16 Band Filterbank | 16 |

ACT is adaptive in many ways. The first would be environmental sensing and control. Features are more or less accessible under different noise conditions. That is, each noise condition affects the different features probability of accuracy, and hence ability to classify a phoneme. For instance, the zero-crossings correlates could be used to identify fricatives in a speech signal. However, the zero-crossing correlate becomes distorted in additive Gaussian noise and other correlates become more informative. Thus different ways of looking at the same data are more robust over certain intervals, so processing is suited to reconstructing the data stream from the higher probability features, while de-emphasizing the high variance predictors. Also, the different phonemes are better represented by different feature sets. For example, formant tracking is unstable for identifying unvoiced fricatives, while Linear Prediction produces better results. In this case, the output of the ACT processing scheme is a reconstruction of the input signal from the Linear Predictive Correlative measure minus a small fraction of formant tracked energy. This process can be thought of as a mixture of experts with a penalty function on poor experts. In this way, possibly confounding information has been removed from the neural code.

The ACT processing scheme is adaptive in that environmental effects change the prediction structure as well as the allophone/classification structure, where an allophone is the real representation and a phoneme is the ideal representation. That is, one deals with allophones in real situations, but the prototype that is compared to is a phoneme. Thus because of prosody and environmental effects the acoustic cues for a phoneme are different (i.e. one hears an allophone with a different time course) and it is the ACT that makes use of this information to change its behaviour. So the ACT processing scheme employs prosody, predictive measures and environmental sensing through embedding prior knowledge into the training phase. The predictive measures involve using a priori knowledge of how the correlates change in time and frequency to shorten the search for the closest ideal phoneme that corresponds to the input signal that is being analyzed. Accordingly, the ACT processing scheme does not involve looking at an entire dictionary as is done in the ADPP processing scheme. Rather, a projection onto the correlate space is done and this space is dimensionally reduced using prediction, and hence is computationally less taxing.

The tracking from time-step to time-step can be accomplished with any state predictor/measurement. The most widely known would be the Kalman filter, which is optimal in Gaussian distributed noise. Since competing speech will be very non-Gaussian a better option will be the Particle filter which can sample from any shaped posterior that is defined in the training sequence. In general terms the present state of correlates for the current phoneme, $X_k$, is a combination of the previous correlate structure in time, $x_{k-1}$, as well as some generative input, $u_{k-1}$, and noise $w_{k-1}$:

$$x_k = Ax_{k-1} + Bu_{k-1} + w_{k-1} \tag{8}$$

where A and B are state transition matrices. In this case x is an arbitrarily long vector, the size of the total number of correlates used. A and B are adaptive transition matrices depending on the phoneme classification and environmental classification. These matrices are learnt transition probability matrices, derived through training with the phonemically labeled stimulus corpus. They are the inference parameters of how the previous acoustic cue set can be used to predict the present set, as such they can be viewed as streaming parameters. Here phonemic classification is a function of the distribution of x. These are understood to be stochastic. Now a measurement is made, $Z_k$, about the incoming signal $$z_k = Hx_k + v_k \tag{9}$$

where $v_k$ is noise, and H is the measurement matrix and is usually given as linear, but may not be in this case. The Kalman filter assumes $w_{k-1}$, and $v_k$ to be Gaussian, and the prediction of the phonemic class is the combination of state prediction, $x_k$, and measurement, $z_k$, weighted by their variances. That is, the information with the lower variance is weighted as closer to the actual class. Since not all speech environments and interferers are Gaussian, the inventors have used particle filters to integrate the multiple cues for classification. Particle filters are described in the book *Sequential Monte Carlo methods in practice*, Doucet, De Freitas, Gordon (eds.) Springer-Verlag 2001.

The processing of ACT is again optimal, stochastic filtering using the particle filter or Kalman filter. Given the probability that the acoustic cue set and predictive classification equals the same phonemic family with high confidence (or low prediction variance), the reconstruction should rely more heavily on the low variance correlates (dimensions of x that correspond to low values of w, where both are the same length) to avoid masking. That is, the impaired auditory system has reduced ability to unmask competing cues or is no longer an optimal detector. This suboptimality coupled with use of an overcomplete description in the ACT, allows for the processing to attenuate less informative cues, or cues that are not useful for a particular phoneme, increasing the SNR in informative cues. In the more realistic case of not having full confidence in classification, the confidence acts as a combination factor between the input signal and processing the signal. The confidence in phonemic prediction, α, can be thought of as a value between zero and one, and the real case output, y, is then the combination of the input, x, and what the output would be given ideal confidence and full processing, ŷ, or:

$$y=(1-\alpha)x+\alpha\hat{y} \tag{10}$$

Figure 4B:
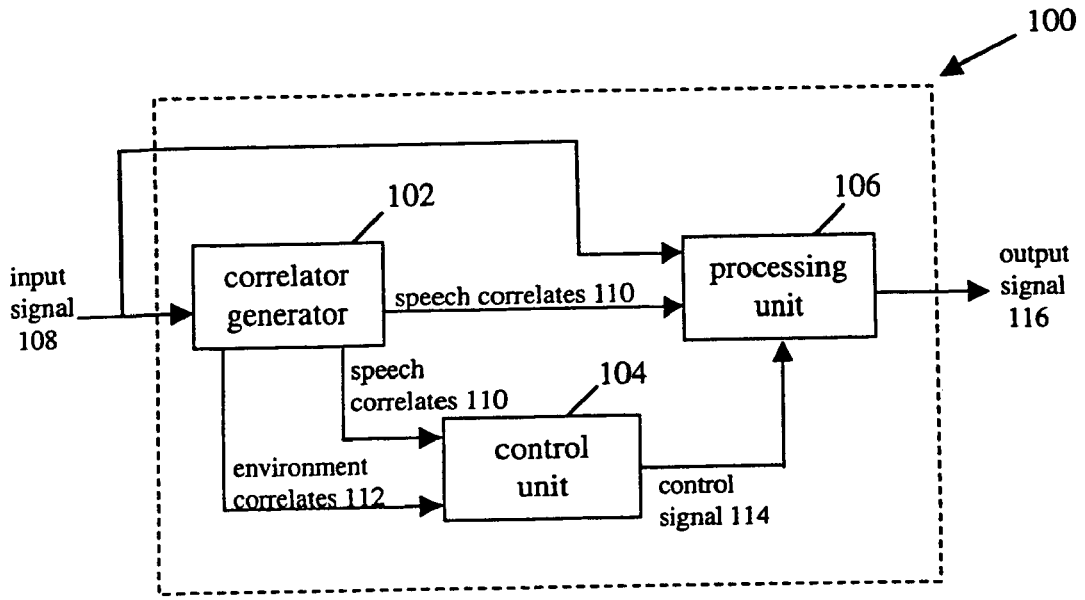
FIG. 4*b* is a block diagram of an Acoustic Correlative unit.

Referring now to FIG. 4*b*, shown therein is a block diagram of an acoustic correlate unit 100 comprising a correlate generator 102, a control unit 104 and a processing unit 106. The correlate generator 102 receives an input signal 108 and generates correlates according to the correlate set provided in Table 1 (the input signal 108 may be the directional signals 22 and 30 in FIG. 1). Some of the correlates (i.e. speech correlates 110) will allow for the identification of speech in the input signal 104 while other correlates (i.e. environment correlates 112) will allow for an identification of the environment. The speech correlates 110 and the environment correlates 112 are then provided to the control unit 104 which processes these correlates to determine the type of noise in the environment and the type of phonemes that are present in the input signal 108. For example, a high energy, high zero crossing count usually pertains to a noisy environment, but neither can be emphasized per se, to increase intelligibility. Hence, the acoustic event set is about identifying speech as well as conditions affecting speech. The speech correlates 110 and the input signal 108 are provided to the processing unit 106 for processing the input signal 108 and tracking certain features in the input signal 108. The control unit 104 provides a control signal 114 to direct the processing unit 106 on how to process the input signal 108 since different processing algorithms can be used for each family of correlates depending on the noise in the environment and the phoneme in the input signal 108. The processing unit 106 removes corrupted cues that do not provide detection information on the speech that may be contained in the input signal 108. The processing unit 106 thus reduces noise in the input signal 108 and improves speech that may be contained in the input signal 108. Accordingly, the processing unit 106 provides an output signal 116 with reduced noise and improved speech. The output signal 116 corresponds to the noise-reduced signals 38 and 44 of FIG. 1.

As previously mentioned, the algorithm development for the hearing-aid system 10 is based on the goal of restoring normal neuronal representations in the central auditory system, despite peripheral abnormalities associated with hair cell damage. While there may be some plastic changes in the auditory cortex after receiving altered input resulting from hair cell damage, there is no present evidence that the basic "cortical circuitry" does not work. The processing scheme used in the compensators 26 and 34 transforms the signal by pre-processing the noise-reduced signal 38 with a Neuro-compensator block (discussed in more detail below), such that when the signal is passed through the damaged auditory system of a hearing-impaired person, it will generate the neural representation of a signal passed through the auditory system of a normal person. The hearing-impaired person's auditory system should then be able to process the resultant signal and generate near-normal central auditory representations.

Figure 5A:
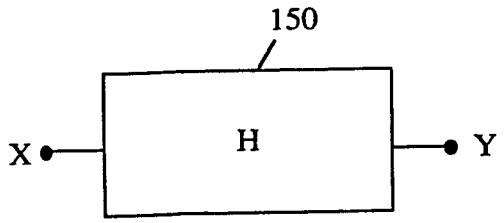
FIG. 5*a* is a block diagram representing a normal hearing system.

A normal hearing system can be described with standard engineering block notation as the system 150 shown in FIG. 5*a* in which an input signal X is modified by the auditory periphery (represented by the transfer function H) to produce a neural response Y. The auditory periphery H is preferably a highly detailed and accurate phenomenological model, since the effectiveness of the algorithms used in the hearing-aid system 10 will be directly proportional to the amount of information from the auditory periphery that one embeds in the design of the transfer function H.

Figure 5B:
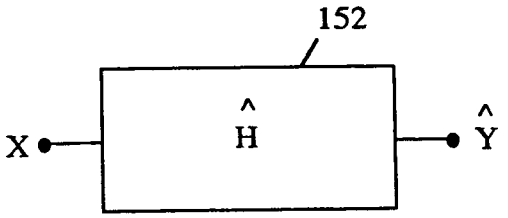
FIG. 5*b* is a block diagram representing a damaged hearing system.

With the loss of hair cells, the auditory periphery is described with a new transfer function $\hat{H}$; that is, as a result of hearing impairment, the system 152 then becomes the one shown in FIG. 5*b*. In the system 152, the same input signal X produces a distorted neural signal $\hat{Y}$ when processed by the damaged hearing system $\hat{H}$. Accordingly, the first step in compensating for impairment due to hair cell loss is to alter the input signal X to produce a normal neural code Y which the central auditory system can process.

Figure 5C:
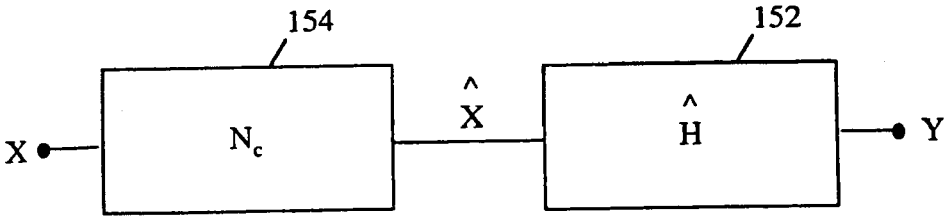
FIG. 5*c* is a block diagram representing a compensated damaged hearing system.

Referring now to FIG. 5*c*, the inventive algorithm used to alter the input signal X is implemented in a Neuro-compensator ($N_c$) 154 to produce a pre-processed signal $\hat{Y}$ as shown in FIG. 5*c*. If the impaired auditory periphery $\hat{H}$ was a simple linear system, then one could invert the damaged model, and the optimal Neuro-compensator $N_c$ would then be the system $N_c=\hat{H}^{-1}\cdot H$. However, the peripheral auditory system has very important nonlinearities, including time varying filtering capabilities and loss of information due to normalization which means that a perfect inversion of $\hat{H}$ is in general not possible. However, even if $\hat{H}$ is non-invertible, one may still be able to capture its capabilities sufficiently to approach normal hearing. In particular, using a hearing model makes it possible to optimize a hearing-aid algorithm to correct for a particular individual's profile of hearing loss, and whose filtering characteristics depend upon the current acoustic context.

The Neuro-compensator is a neuro-biologically inspired multi-band fitting strategy that incorporates a time-varying gain and compression algorithm. The time-varying gain control is context-dependent, permitting the restoration of some of the nonlinear modulatory effects of the outer hair cells on the basilar membrane. This compensation strategy focuses on the leading cause of hearing impairments: hair cell damage. The transduction of acoustic energy into time-varying spike trains in the auditory nerve is impaired by the loss of hair cells. Complete loss of entire frequency regions often accompanies Inner Hair Cell (IHC) damage, while Outer Hair Cell (OHC) loss produces a broadened frequency response to each of the frequency channels, as well as a loss of nonlinear modulatory effects of the OHCs including loudness compression and cross-frequency interactions.

Figure 6A:
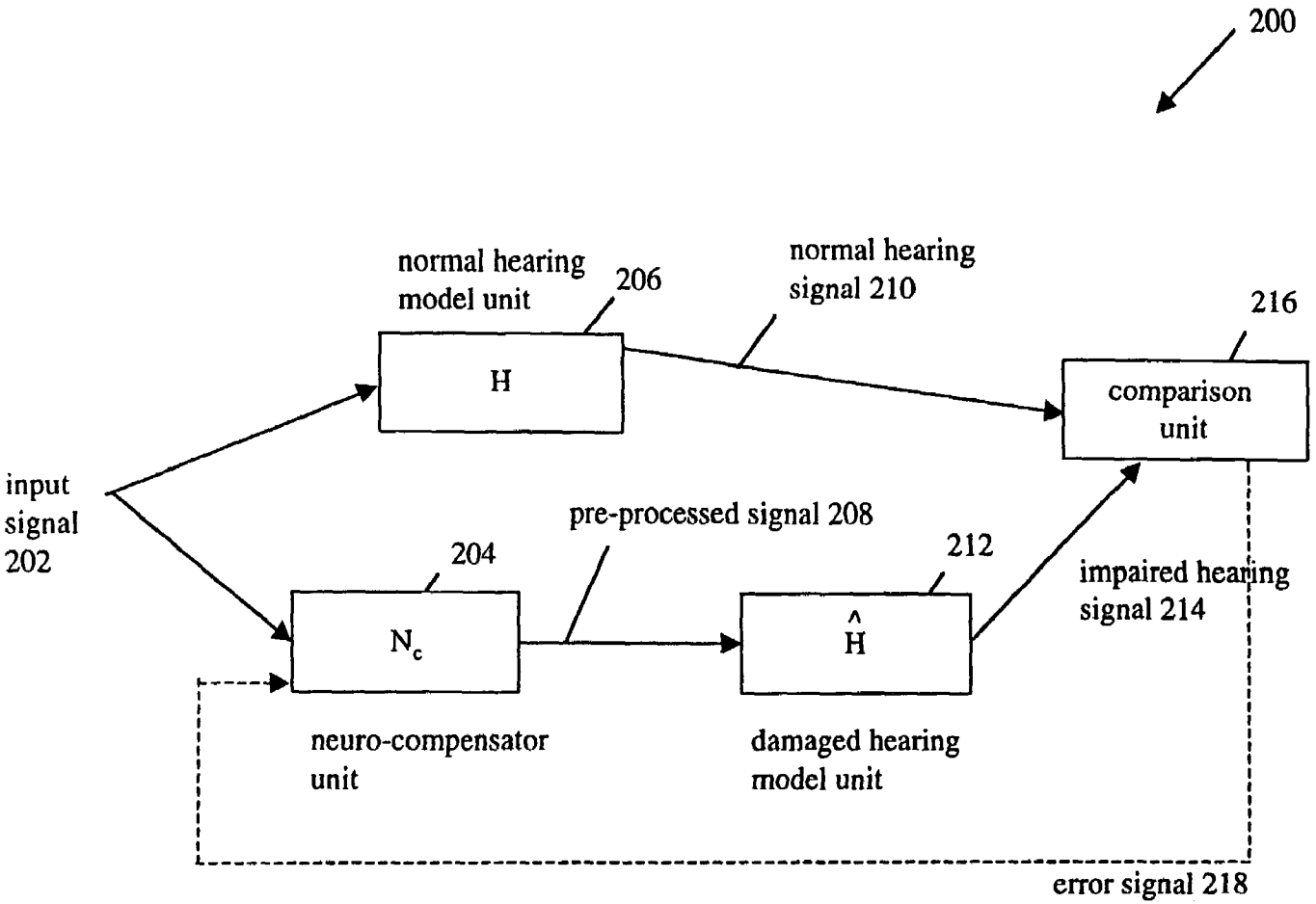
FIG. 6*a* is a block diagram of a compensator.

Referring now to FIG. 6*a*, shown therein is a block diagram of a compensator 200 (which corresponds to the first and second compensators 26 and 34). An input signal 202 (which corresponds to one of the noise-reduced signals 38 and 44) is provided to a normal hearing model unit 206 and a Neuro-compensator unit 204. The normal hearing model unit 206 processes the input signal 202 to produce a normal hearing signal 210. The Neuro-compensator unit 204 processes the same input signal 202 to provide a pre-processed signal 208. The compensator 200 further comprises a damaged hearing model unit 212 which processes the pre-processed signal 208 to produce an impaired hearing signal 214. The normal hearing signal 210 is then compared to the impaired hearing signal 214 by a comparison unit 216 to determine an error signal 218. The error signal 218 is fed back to the Neuro-compensator unit 204 to adjust weights on the elements of the Neuro-compensator unit 204 such that the impaired hearing signal 214 will approximate the normal hearing signal 210. The impaired hearing signal 214 may represent either of the compensated signals 40 and 46 of FIG. 1. Accordingly, the processing performed by the compensator 200 is such that the output 210 from the normal hearing model unit 206 and the output 212 from the hearing impaired model unit 212 are substantially similar.

The parameters of the Neuro-compensator unit 204 are tuned optimally on training sequences of auditory input to correct for an individual's hearing loss. The damaged hearing model 212 will vary on an individual basis, and therefore, the Neuro-compensator unit 204 will find optimal parameters to correct for that particular individual's loss. The Neuro-compensator unit 204 can be implemented in the form of a neural network, as described below. The neural network is nonlinear so the effect of the Neuro-compensator unit 204 is not simply to sharpen the signal in compensation for the broadened frequency-tuning of the damaged hair cells. This is intuitively satisfying since the cochlea, which contains the hair cells, is a nonlinear filtering system.

The Neuro-compensator unit 204 generates a set of gain coefficients. The gain coefficient for a frequency band i in the Neuro-compensator unit 204 is given by:

$$G_i = \frac{v_i f_i^2}{\sum_j w_{ij} f_j^2 + \sigma} \tag{11}$$

The gain coefficient $G_i$, for each frequency i, is computed as a function of the energy at that frequency (represented by $f_i^2$) normalized by a weighted combination of the energies across all frequencies where σ is a small constant. In initial tests a was set to 1 percent of the mean value of $f_i^2$ although other values can be used for a to assure that the model never assigns infinite gain. For each frequency band i, a different set of weights $v_i$ and $w_{ijj}$, and hence a different gain function, is learnt. The selection of weights $v_i$ and $w_{ij}$ will be determined using a supervised learning procedure, using a criterion for intelligibility as the objective function. Alternatively, the weights $v_i$ and $w_{ij}$ can be trained such that the output of the impaired hearing model unit is substantially similar to the output of the hearing model unit. The inventors have found that there is different error adjustment in different frequency bands, which reflects the importance of frequency weighting.

A slightly more complex variant of the above structure for the Neuro-compensator incorporates time-lagged inputs, to better restore temporal processing to the damaged system:

$$W_i = \frac{v_i}{\left(\sum_{j=1}^{20} w_{ij} f_j\right)^{1/4} + \left[\sum_{k=0}^{4}\left(z_{ik}\sum_{j=1}^{20} f_j^{n-k}\right)^{1/4}\right] + \sigma} \tag{12}$$

where $W_i$ are the weights for a particular time-slice at the $i^{th}$ frequency, $f_j$ is the magnitude of the input signal 202 at the $j^{th}$ frequency band, $v_i$ is the optimized average gain, $w_{ij}$ is the optimized band to band inhibition, $z_{ik}$ is the optimized total power inhibition for past times and σ is some small value to ensure the model never assigns infinite gain. The optimized average gain v can be thought of as a base gain in each frequency band i, the optimized band-to-band inhibition z can be thought of as a dynamic range reduction for each frequency band i, and the optimized total power inhibition for past times z is similar to the weights $w_{ij}$ but contain some time information. The optimized average gain v, optimized band-to-band inhibition z and optimized total power inhibition for past times can be trained (using stochastic optimization for example) such that the output of the normal model hearing unit and the impaired hearing model unit will be substantially similar. In addition, values for these parameters will be determined on a subject-by-subject basis.

The gain coefficients conceptually provide "Divisive Normalization" which is similar to lateral inhibition in sensory systems, and has been proposed as an important neurological filtering operation in models of early sensory processing in both vision and audition. A key property of divisive normalization is contrast enhancement, a property that is lost through outer hair cell damage. Thus, an impairment strategy that mimics this important mechanism of contrast enhancement in the normal auditory system is useful in the compensator 204, to correct for the loss of this function in the damaged hearing model unit 212.

There are many possibilities for Neuro-compensator processing blocks. Any general nonlinear function can be fit with a neural network in theory (although the learning problem in general is NP-hard and is therefore not guaranteed to be tractable). Thus a preferable implementation will be a multiplayer neural network. The feedforward multiplayer perceptron (MLP), time-delay neural network (TDNN) and Decoupled Extended Kalman Filter (DEKF) neural network are three exemplary possibilities. The MLP can approximate level dependent gain, spectral enhancement and spectral shifts, with very few nodes. The TDNN and DEKF network, because of time recursion, have a special ability to compensate time adaptive behaviour. All three of these implementations are well known to those skilled in the art.

The gain functions can be optimized to compensate for specific patterns of interference in the damaged hearing model in unit 212. The phenomological differences between the sensorineural impaired and the normal hearing include: Absolute Threshold, Spectro-Temporal Integration of Loudness, Temporal Resolution, Sound Localization, Frequency Resolution, Modulation Detection, Pitch Perception and Binaural Unmasking. The differences between the normal hearing and the hard of hearing are preferably explained in the Neuro-compensator processing block, and an Artificial Neural Network (ANN) is one possibility for implementation. For example, if low frequencies are interfering with the detection of higher frequencies, the Neuro-compensator unit 204 can learn a gain function for the lower frequencies that heavily weights higher frequencies in the normalizing term. This will reduce the gain on lower frequency channels in the presence of high frequencies. To accomplish level-dependent bandwidth modulation, several copies of the Neuro-compensator unit 204 can each be trained on different subsets of the training data, each with a different average loudness. Thus with environmental sensing one can switch the weights of the Neuro-compensator 204 to fit different background or loudness conditions.

The Neuro-compensator unit 204 is trained on a set of acoustic signals. For each training signal, the Neuro-compensator unit 204 calculates the optimal gain for each frequency band by combining information across multiple frequency bands and time steps. Simple LTASS noise, as a training signal for the Neuro-compensator, will lead to reasonable average performance, but will not be able to capture the important temporal modulations of speech, or the rapid transients in unvoiced sounds such as stops and fricatives. Some better possibilities include free-running speech (TIMIT), or mixtures of multiple competing speech sources, allowing for training on transient information.

Figure 6B:
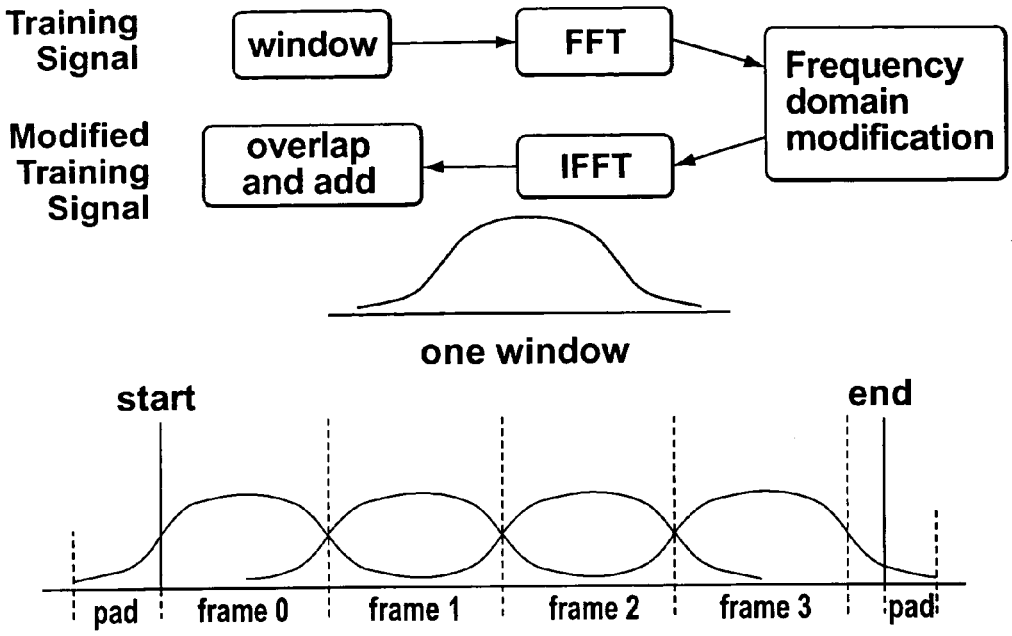
FIG. 6*b* is a diagram that illustrates the processing that is performed during the training of the compensator.

Reference is now made to FIG. 6*b* which illustrates the processing that is done during the training of the Neuro-compensator unit 204. The first step in training the Neuro-compensator unit 204 is a pre-processing stage where a training signal is compartmentalized into time-overlapped windowed samples. These windowed samples are filtered into a number of frequency bands, e.g., the inventors have investigated four, eight, eleven, sixteen, twenty and thirty-two bands, depending on the end processing complexity, to provide a set of frequency-specific time series. The number of frequency bands in the training signal corresponds to the number of frequency bands that are used in the normal and damaged hearing model units 206 and 212. The number of frequency bands will determine the error signal 216.

One then computes the $i^{th}$ weight $W_i$ for the Neuro-compensator and applies this per time slice weight to the corresponding frequency-specific time series in the frequency domain modification block. The frequency-specific time series are then converted to the time domain and summed to create one time-slice of output waveform (i.e. the modified training signal in FIG. 6*b*). All the time-slices are assembled by overlapping and adding the processed windowed samples (i.e. the overlap and add method is used which is commonly known to those skilled in the art). The resulting output waveform corresponds to the pre-processed signal 208 that is the input to the damaged hearing model unit 212. The input signal to the normal hearing model unit 202 can be thought of having weights $W_i$ with a magnitude of unity over every frequency and every time-slice.

An error signal, or Neural Distortion (ND), is derived by comparing the instantaneous spiking rates in units of spikes/second (before the effects of refractoriness are considered) in the normal (control) and impaired (test) hearing models' output signals 210 and 214 (see the hearing model 300 below for a discussion of instantaneous spiking rates). The ND is defined as:

$$ND = 1 - \frac{\text{Test}\cdot\text{Control}'}{\text{Control}\cdot\text{Control}'} \tag{13}$$

where Control and Test are vectors of the instantaneous spike rate over time. This error metric can be thought of as a normalized, second order, Hebbian learning rule, because it uses the cross correlation between the Control and Test signals. The Control and Test vectors are provided by a spike generator unit which is in both the normal hearing model unit 206 and the damaged hearing model unit 212 (this is described in more detail below). The synaptic release rate in the model is comparable to the Auditory Nerve (AN) fibre spike rate (in units of spikes/second). A vector of NDs over different frequency bands between the normal hearing signal 210 and the impaired hearing signal 214 is summed in the comparison unit 216 to produce the error signal 218. The comparison unit 216 uses the Speech Transmission Index (STI) frequency importance weighting method which comprises the vector $\alpha$ that has frequency weight components for weighting the ND for a particular frequency band. The vector $\alpha$ contains normalized weights that add up to one with values chosen according to the spectral region of speech. For instance, weights for frequency bands lower than 2 kHz have lower values that weights for frequency bands in the region of 2 to 4 kHz. The selection of values for the vector $\alpha$ is discussed in more detail by Bondy et al. (Bondy, Bruce, Becker, Haykin, "Predicting Intelligibility from a population of neurons", Advances in Neural Processing Systems, NIPS 2003). The single error value is then a Neural Articulation Index (NAI) of the form:

$$NAI = \sum_{i=1}^{N} \alpha_i \cdot ND_i \tag{14}$$

where the sum contains any, N, number of frequency bands. Speech has a wide bandwidth and therefore cannot be represented through only one frequency of the auditory model. The auditory system also has spread of masking which makes different frequency bands distort one another if the sound intensity of a frequency component is too loud. Thus one cannot simply use the ND to optimize intelligibility per band, because the spread of masking would not be taking into consideration. The NAI takes this into account, as well as how different frequency bands contribute differently to intelligibility. This is done by using the STI weighting structure ($\alpha_i$).

Using the error signal 218 described above, the Alopex algorithm (Unnikrishnan, K. P. and Venugopal, K. P., "Alopex: A correlation-based learning algorithm for feed-forward and recurrent neural networks", Neural Computation, 6(3), May 1994; Bia, A., "Alopex-B: A new, simpler but yet faster version of the Alopex training algorithm", International Journal of Neural Systems, Special Issue on Non-gradient optimisation methods, pp. 497–507, 2001) can be used to train the weights in the Neuro-compensator unit 204. The Alopex algorithm is a stochastic optimisation algorithm that is closely related to reinforcement learning and dynamic programming methods. The Alopex algorithm relies on the correlation between successive positive/negative weight changes and changes in the global error or objective function from trial to trial to stochastically decide in which direction to move each weight.

The Alopex algorithm is a gradient-free optimization method requiring only the calculation of objective function values. Unlike gradient-based methods such as back-propagation, it therefore does not make any restrictive assumptions about smoothness or differentiability of the transfer functions of individual neurons in the neural network of the Neuro-compensator unit 204. It also does not explicitly depend on either the functional form of the error measure, or the architecture: the same learning algorithm is applicable to both feed-forward and recurrent networks. All of the weights in the neural network are updated simultaneously, using only local computations which allows for parallelization of the algorithm. The Alopex algorithm may also use a "temperature parameter" in a manner similar to that used in simulated annealing, to control the level of stochasticity in the weight changes, as described further below.

The objective of learning in a neural network is to minimize an error measure with respect to the network weights when the network is provided with a set of appropriate training samples. Unnikrishnan et al. describe the algorithm as follows: consider a neuron i with a weight $w_{ij}$ that describes the interconnection strength from neuron j.

During the $n^{th}$ iteration of the learning algorithm, the weight $w_{ij}$ is calculated according to:

$$w_{ij}(n)=w_{ij}(n-1)+\delta_{ij}(n) \tag{15}$$

where for the first two iterations, the weights are chosen randomly. The parameter $\delta_{ij}(n)$ is a small positive or negative value having a step of size δ according to the probabilities:

$$\delta_{ij}(n)=-\delta \text{ with probability } p_{ij}(n) \tag{16}$$

$$\delta_{ij}(n)=+\delta \text{ with probability } 1-p_{ij}(n) \tag{17}$$

where the probabilistic decision is made by generating a uniform random number between 0 and 1 and comparing it with $p_{ij}(n)$. The probability p(n) for a negative step is given by the Boltzmann distribution:

$$p_{ij}(n) = \frac{1}{1+e^{\frac{-C_{ij}(n)}{T(n)}}} \tag{18}$$

where $C_{ij}(n)=\Delta w_{ij}(n)\cdot\Delta E(n)$ and T(n) is a positive 'temperature' parameter. The quantities $\Delta w_{ij}(n)$ and ΔE(n) are the changes in weight $w_{ij}$ and the error measure E, respectively, over the previous two iterations, as given by:

$$\Delta w_{ij}(n)=w_{ij}(n-1)-w_{ij}(n-2) \tag{19}$$

$$\Delta E(n)=E(n-1)-E(n-2) \tag{20}$$

The temperature parameter T can be updated every N iterations according to:

$$T(n) = \frac{1}{N\cdot M}\sum_{i}\sum_{j}\sum_{n'=n-N}^{n-1}\left|C_{ij}(n')\right| \tag{21}$$

if $n$ is a multiple of $N$ $$T(n)=T(n1) \text{ otherwise} \tag{22}$$

The parameter M in equation 21 is the total number of connections in the neural network. Since the magnitude of Δw is the same for all weights, then the temperature parameter T can be updated according to:

$$T(n) = \frac{\delta}{N}\sum_{n'=n-N}^{n-1}\left|\Delta E(n')\right| \tag{23}$$

If ΔE is negative then the probability of moving each weight in the same direction is greater than 0.5. If ΔE is positive, then the probability of moving each weight in the opposite direction is greater than 0.5. The Alopex algorithm favors weight changes that will decrease the error measure E.

The temperature parameter T determines the stochasticity of the Alopex algorithm. When the parameter T has a non-zero value, the algorithm takes biased random walks in the weight space for decreasing the error E. If the value of the temperature parameter T is too large, the probabilities are close to 0.5 and the Alopex algorithm does not find the global minimum of the error measure E. If the temperature parameter T is too small, the Alopex algorithm may converge to a local minima of the error measure E.

Alternatively, a "dither strategy", can also be used to train the weights of the Neuro-compensator unit 204. The "dither strategy" alters one parameter per iteration, runs through the normal and impaired model, and calculates the NAI. The change in the parameter is discarded if the error signal 218 is larger then that of a previous iteration, or else kept and another parameter is chosen.

During the training phase, gain coefficients in the Neuro-compensator unit 204 are applied to the training signal before it enters the damaged hearing model unit 212. The output of the damaged hearing model unit 212 can then be compared to that of the normal hearing model unit 206, to calculate the error signal 218. The parameters of the Neuro-compensator unit 204 are adjusted (for example, parameters $v_i$, $y_{ij}$, $z_{ik}$, from equation (12)) to minimize the error signal 218, so that the output of the damaged hearing model unit 212 matches that of the normal hearing model unit 206 as closely as possible. Once the Neuro-compensator unit 204 is trained, the gain coefficients are finalized, and the detailed hearing models are no longer needed. Thus, the Neuro-compensator in the field adapts to changes of the inputs, but the underlying structure is fixed.

The Neuro-compensator unit 204 has a number of advantages over traditional approaches. Traditional hearing-aids calculate gain on a frequency-by-frequency basis at the time of fitting the device, and these gains are then held fixed. The gains are determined solely by the audiogram, which measures detection thresholds for pure tones at different frequencies, without taking into account masking effects due to cross-frequency/cross-temporal interactions. Such methods work well for restoring the detection of pure tones but fail to correct for many of the masking and interference effects caused by the loss of outer hair cell nonlinear filtering. Meanwhile, the Neuro-compensator unit 204 has the capability to restore a number of the filtering capabilities afforded by the outer hair cells. Furthermore, as mentioned above, the Neuro-compensator unit 204 can learn to optimize itself automatically to an individual's profile of hearing loss for highly optimized performance.

Perceptual distortions from sensorineural impairment are minimized by the Neuro-compensator block 204 by re-establishing in the impaired auditory system the normal pattern of neuronal firing. The methodology therefore depends on a detailed model of the peripheral auditory system. Actually the hearing models are a population of hearing models for a set of different preferred frequencies, and any number of frequencies can be used, although too few frequencies will likely result in a loss of intelligibility for the hearing-aid wearer. Based on industry standards and empirical tests, 20 frequencies are typically used. The damaged population is defined through best frequency specific IHC and OHC loss factors (i.e. percentages between [0,1] as described further below). These loss factors alter thresholds and $Q_{10}$ values across the frequency spectrum to model a particular individual's hearing loss.

Figure 7:
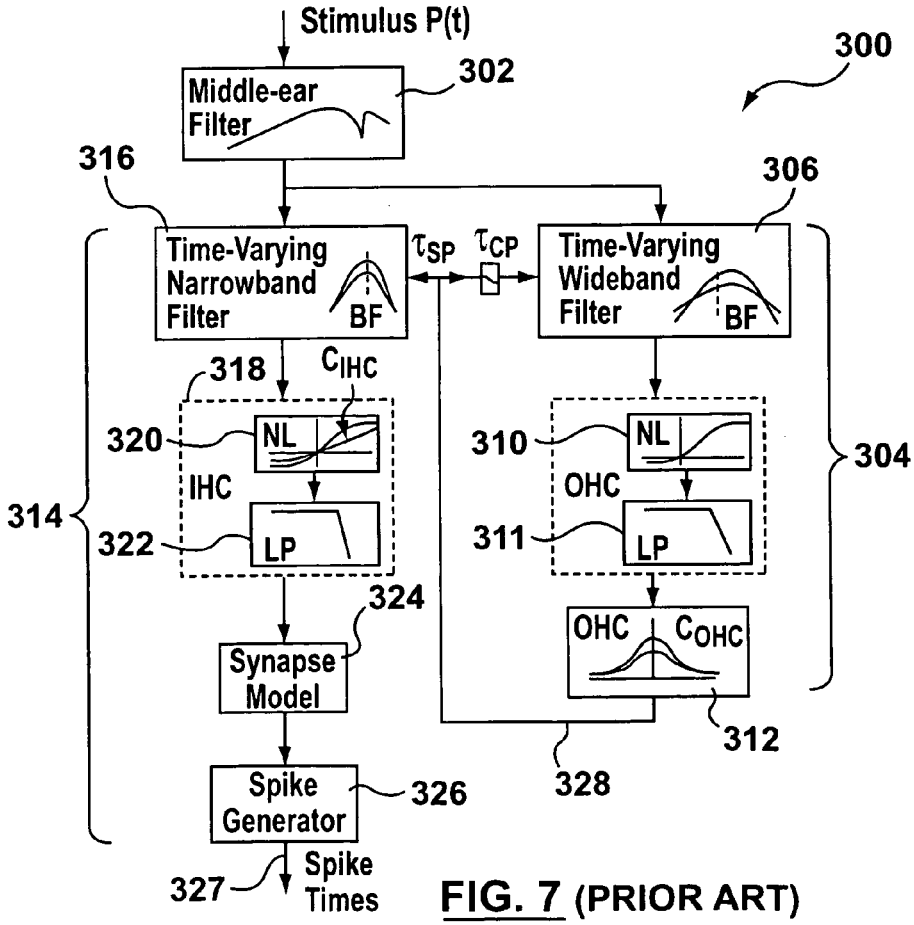
FIG. 7 (PRIOR ART)
FIG. 7 is a block diagram of a hearing model.

Referring now to FIG. 7, shown therein is a block diagram of a hearing model 300 that can be used by the normal and damaged hearing model units 206 and 212. In the hearing model 300, the functionality of hair cells is important since hair cell loss affects both fast and slow adaptations to sounds and other important non-linearities of the human auditory system. Accordingly, the hearing model 300 can model the following general cases which include the effects of outer hair cells (OHCs) and inner hair cells (IHC) in the normal case as well as with mild and severe sensorineural hearing loss. Normally OHCs act upon the basilar membrane (BM) to produce a sharp tuning curve in auditory nerve fibers (i.e.

a bandpass function with a high Q factor) with a low auditory threshold. However, after mild sensorineural hearing loss, primarily associated with OHC damage, auditory nerve fibers exhibit an elevated firing threshold and a broader, flatter frequency tuning curve (i.e. a bandpass function with a lower Q factor) at their Best Frequency (BF). With more severe sensorineural hearing loss there is damage to both IHCs and OHCs, associated with an even greater elevation in auditory thresholds and a wider tuning curve of auditory nerve fibers at their BF.

The hearing model 300 is that of Bruce et al. (Bruce, I. C.; Sachs, M. B.; Young, E. D., "An auditory-periphery model of the effects of acoustic trauma on auditory nerve responses", JASA 113(1), January 2003, pp. 369–388), which was modified from Zhang et al. (Zhang, X.; Heinz, M. G.; Bruce, I. C.; Carney, L. H., "A Phenomenological Model for the Responses of Auditory-Nerve Fibers: I. Nonlinear Tuning with Compression and Suppression," JASA 109(2), February 2001, pp. 648–670). The hearing model 300 comprises several sections which each provide a phenomenological description of a different part of auditory-periphery function. Other hearing models that may be used include the Sumner model (Sumner, CJ, Lopez-Poveda, E A, O'Mard, L P, & Meddis, R (2002) "A revised model of the inner-hair cell and auditory nerve complex" J. Acoust. Soc.Am. 111 (5), Pt. 1.2178–2188) and the Nobili model (Nobili, R, & Mammano, F (1996) "Biophysics of the cochlea II: Stationary nonlinear phenomenology" J. Acoust. Soc. Am. 99(4), Pt. 1.2244–2255).

The first section of the hearing model 300 is a middle ear (ME) filter 302 that models the middle ear processing. The processing of the outer ear is not modeled since the acoustic input signal is delivered directly to the ME of the hearing impaired person via miniature speakers and the like. The ME filter 302 models responses to wideband stimuli such as vowels by changing the relative levels of components in the acoustic input signal. The ME section of the auditory-periphery model was created by combining the ME cavities model of Peake et al. (Peake, W. T., Rosowski, J. J., and Lynch, III, T. J., 1992, "Middle-ear transmission: Acoustic versus ossicular coupling in cat and human," Hear. Res. 57, 245–268) with the ME model of Matthews (Matthews, J. W., 1983, "Modeling reverse middle ear transmission of acoustic distortion signals," in *Mechanics of Hearing: Proceedings of the IUTAM/ICA Symposium*, edited by E. de Boer and M. A. Viergever, Delft U. P., Delft, pp. 11–18).

Figure 8A:
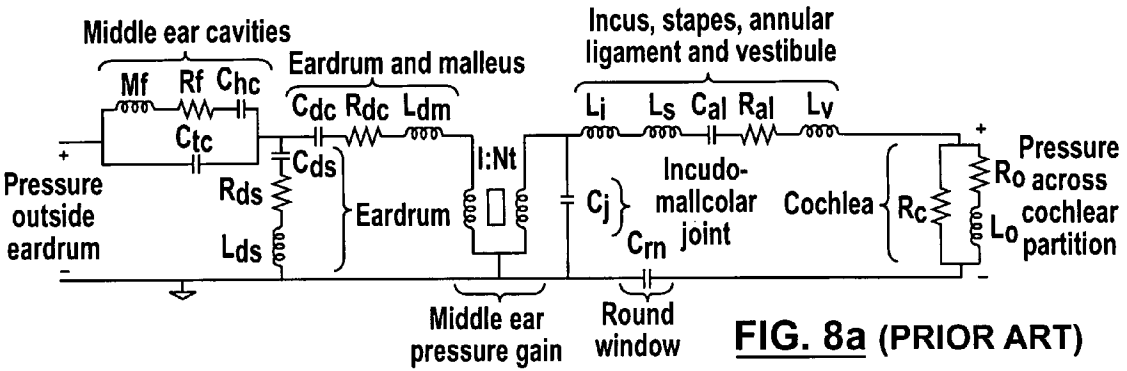
FIG. 8a (PRIOR ART)
FIG. 8*a* is an electrical-circuit representation of a middle-ear model.

An electrical-circuit representation of the composite middle ear model is shown in FIG. 8*a* and the circuit-element values are given in Table 2 (the circuit omits the round-window compliance $C_{rw}$,). A transfer-function representation G(s) of the middle ear circuit that represents the transfer of pressure from outside of the eardrum to the cochlear partition was determined using the computer program SAPWIN by Liberatore et al. (Liberatore, A., Luchetta, A., Manetti, S., and Piccirilli, M. C., 1995, "A new symbolic program package for the interactive design of analog circuits," in *ISCAS '95, IEEE International Symposium on Circuits and Systems*, 1995, Vol. 3 (IEEE, Piscataway, N.J.), pp. 2209–2212). The transfer function G(s) is given by G(s)=NUM(s)/DEN(s) where s is in units of rad/s and:

$$\mathrm{NUM}(s)\sim=4.1\times10^{-55}(s^8)+1\times10^{-50}(s^{10})+4.1\times10^{-46}(s^6)+7.5\times10^{-42}(s^5)+7.1\times10^{-38}(s^4)+8.7\times10^{-36}(s^3) \quad (24)$$

$$\mathrm{DEN}(s)\sim=2.4\times10^{-70}(s^{11})+1.9\times10^{-65}(s^{10})+1.6\times10^{-60}(s^9)+5.8\times10^{-56}(s^8)+1.9\times10^{-51}(s^7)+3.9\times10^{-47}(s^6)+5.4\times10^{-43}(s^5)+4.2\times10^{-39}(s^4)+2\times10^{-35}(s^3)+1.2\times10^{-32}(s^2)+2.6\times10^{-44}(s) \quad (25)$$

Figure 8B:
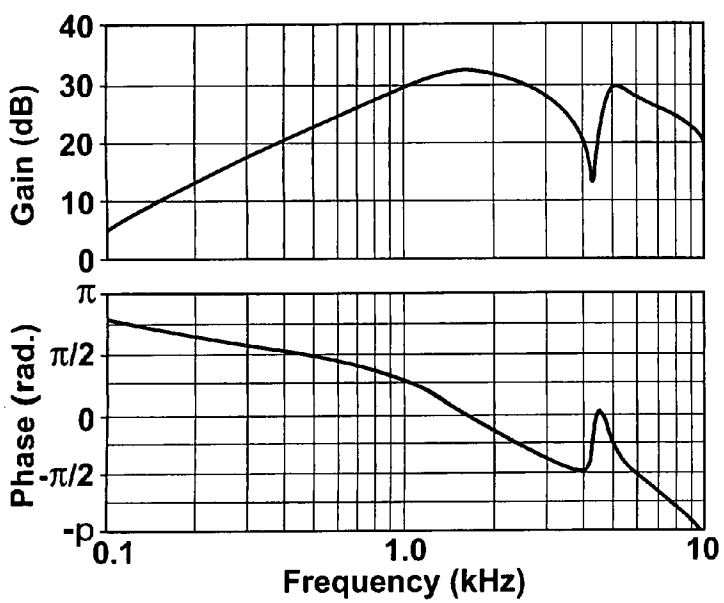
FIG. 8b (PRIOR ART)
FIG. 8*b* shows the gain and phase of the frequency response of the electrical circuit representation of FIG. 8*a*; and, FIG. 9 is a plot of gain functions of a time-varying narrowband filter used in a hearing model plotted as gain versus frequency deviation.

A tenth-order, IIR digital filter was created with a sampling frequency of 100 kHz to implement the transfer function G(s). The gain and phase of the frequency response of the digital filter are shown in FIG. 8*b*. The ME filter 302 has a maximum gain of 32 dB. However, the gain of the ME filter 302 is scaled to a maximum gain of 0 dB to avoid having to adjust other level dependent parameters of the auditory periphery model 300.

TABLE 2

Circuit Values for Middle Ear Model

| | | | |
|---|---|---|---|
| Mf = 0.0101 | Cj = $1.2 \times 10^{-11}$ | Rf = 13.7 | Li = 1.6 |
| Cbc = $5.55 \times 10^{-7}$ | Ls = 3.3 | Ctc = $1.75 \times 10^{-7}$ | Lv = 22 |
| Cds = $8 \times 10^{-8}$ | Ca1 = $3.7 \times 10^{-10}$ | Rds = 1300 | Ra1 = $2 \times 10^5$ |
| Lds = 0.054 | Rc = $1.2 \times 10^6$ | Cdc = $3.5 \times 10^{-7}$ | Ro = $2.8 \times 10^5$ |
| Rdc = 55.2 | Lo = 2250 | Ldm = 0.04 | Crw = $1 \times 10^{-8}$ |
| Nt = 55 | | | |

Note:
For the values given for the circuit elements, the units used are: [pressure] = dyne/cm$^2$ ≡ [voltage] = volt; [volume velocity] ≡ cm$^3$/s ≡ [current] = ampere; [acoustic compliance] = cm$^5$/dyne ≡ [capacitance] = farad; [acoustic mass] = g/cm$^4$ ≡ [inductance] = henry; [acoustic damping] = dyne · s/cm$^5$ ≡ [resistance] = ohm; [acoustic impedance] = dyne · s/cm$^5$ ≡ [impedance] = ohm.

The second section of the hearing model 300 describes a control path 304 which includes a wideband, nonlinear, time varying, band-pass filter 306 followed by an OHC nonlinearity (OHCNL) unit 308 which includes an OHC nonlinearity 310 and a low-pass filter 311. The control path 304 also includes an OHC status block 312 which allows the model to mimic OHC loss. The control path 304 controls the time-varying, nonlinear behavior of a narrowband signal-path Basilar Membrane (BM) filter 316, in a corresponding signal path 314. The control is achieved by adjusting the bandwidth and gain of the BM filter 316 through a time constant $\tau_{sp}$. The control-path filter 306 has a wider bandwidth than the signal-path filter 316 to account for wideband nonlinear phenomena such as two-tone rate suppression.

The third section of the hearing model 300 is the signal path 314 that describes the filter properties and traveling wave delay of the BM (represented by the signal path filter 316). The signal path 314 also includes an IHC non-linearity (IHCNL) unit 318 that describes the nonlinear transduction and low-pass filtering of the inner hair cell. The IHCNL unit 318 includes an IHC non-linearity 320 and a low-pass filter 322. The signal path 314 also includes a synapse model unit 324 that describes the spontaneous and driven activity and adaptation in synaptic transmission, and a spike generator 326 that describes the spike generation and refractoriness in the auditory neuron of the auditory periphery. The output of the synapse model unit 324, the synaptic release rate, is used for the normal and impaired hearing signals 210 and 214 in order to generate the error signal 218 (see FIG. 6*a*). The output 327 of the spike generator 326 is a train of pulses which mimics the instantaneous neural firing rate in units of spikes/second in the peripheral auditory system.

The center frequency of the signal-path filter 316 predominantly defines the model fiber's BF (i.e. Best Frequency which is the frequency at which the fiber is most sensitive). The bandwidth and gain of both the signal-path filter 316 and the control-path filter 306 are varied continuously as a function of the control path output 328. The low-pass filtering 322 of the low-pass filter 322 describes the fall-off in pure-tone synchrony with increasing BF above 1 kHz. The preceding IHC non-linearity 320 produces a dc component in the IHCs of high-BF model fibers, providing non-synchronized synaptic drive to such fibers. The spontaneous rate (which can be 50 spikes/second before the effects of refractoriness), adaptation properties and rate-level behavior (including threshold and saturation) of a model fiber are determined by the synapse model 324. Only high spontaneous rate fibers are modeled. The spiking and refractory behaviors are set to model the statistics of spike timing in AN fibers. In the hearing model 300, parameters $C_{IHC}$ and $C_{OHC}$ are scaling constants that are used to control IHC and OHC status, respectively.

Figure 9:
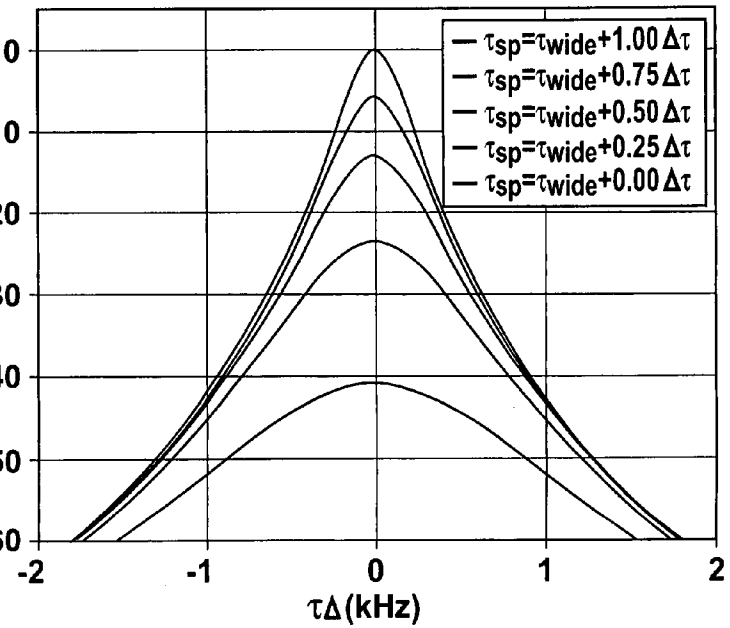
FIG. 9 (PRIOR ART)

The gain functions of linear versions of the signal path filter 316, plotted as gain versus frequency deviation (Δf) from BF is given in FIG. 9. The signal path filter 316 is a fourth-order, non-linear, infinite impulse response filter (IIR) gammatone filter which is realized by cascading three non-linear and one linear first-order, low-pass filters (Zhang et al., 2001). The stimulus waveform is first down-shifted in frequency by the desired center frequency of the filter, then filtered, and finally up-shifted to its original frequencies. Each of the three nonlinear low-pass filters may be described by the difference equation $y[n]=c\mathbf{1}_{LP}[n]y[n-1]+c\mathbf{2}_{LP}[n](x[n]+x[n-1])$ where x is the filter input, y is the filter output, n is the sample number, and the filter coefficients $c\mathbf{1}_{LP}[n]$ and $c\mathbf{2}_{LP}[n]$ are determined by the time constant for the signal path filter $\tau_{sp}$ according to the bilinear transforms: $c\mathbf{1}_{LP}[n]=(\tau_{sp}[n]2F_s-1)/(\tau_{sp}[n]2F_s+1)$ and $c\mathbf{2}_{LP}[n]=1/(\tau_{sp}[n]2F_s+1)$ where the sampling frequency $F_s$ is set at 500 kHz. The time constant $\tau_{sp}[n]$ determines both the gain and the bandwidth of the filter and varies between the values $\tau_{wide}$ and $\tau_{narrow}$ according to the output signal 328 of the control path 304.

The single linear LP filter that follows the three nonlinear LP filters in the signal path filter 316 is identical to the nonlinear filters except that its time constant is always $\tau_{wide}$ and its dc gain (i.e., the gain at BF) is always unity. Responses are plotted in FIG. 9 for five different values of $\tau_{sp}$ between $\tau_{narrow}$ and $\tau_{wide}$; $\Delta\tau=\tau_{narrow}-\tau_{wide}$. The parameter $\tau_{narrow}$ was chosen to produce a 10 dB bandwidth of ~450 Hz, and $\tau_{wide}$ was chosen to produce a maximum gain change at BF of ~−41 dB. This plot can be interpreted as showing the nominal tuning of the filter with normal OHC function at five different sound pressure levels or alternatively as the nominal tuning of the filter for five different degrees of OHC impairment. Decreasing $\tau_{sp}$ from $\tau_{narrow}$ to $\tau_{wide}$ increases both the bandwidth and the attenuation of the signal path filter 316.

The behavior of the signal path filter 316 can be considered over three different ranges of stimulus intensity. First, at low stimulus intensities, the control path signal 328 is negligible and therefore $\tau_{sp}[n]\cong\tau_{narrow}$. Consequently, the bandwidth is narrow, gain is high, and the signal path filter 316 is effectively linear. Second, at moderate stimulus intensities the control path signal 328 becomes significant, such that $\tau_{sp}[n]$ dynamically varies between $\tau_{narrow}$ and $\tau_{wide}$, creating broadened tuning, a compressive non-linearity for stimuli with frequency components near BF, and two-tone suppression for wideband stimuli. The time constant $\tau_{cp}[n]$ of the control path filter 306 is set to a constant fraction K of $\tau_{sp}[n]$, to create an area of suppression that is appropriately wider than the signal-path tuning curve. Two-tone rate suppression is created in the hearing model 300 when a suppressor tone produces negligible energy at the output of the signal path filter but has enough energy at the output of the broader control-path filter 306 to reduce $\tau_{sp}[n]$ via the control path output 328 and consequently reduce the gain of the signal-path filter 316. Third, for very large signals, the control path 304 saturates and $\tau_{sp}[n]$ has an essentially constant value near $\tau_{wide}$. Thus, at high intensities the signal path filter 316 has a broad bandwidth and low gain and is once more linear. These properties simulate the BM tuning and non-linearities that are caused by the activity of healthy OHCs.

The value of the time constant $\tau_{narrow}$ determines the bandwidth of the hearing model threshold tuning curves. The bandwidth of a tuning curve is usually quantified according to its $Q_{10}$ value, which is equal to BF divided by the bandwidth of the tuning curve 10 dB above threshold at BF. The desired $Q_{10}$ value can be produced in the model by setting $\tau_{narrow}=2Q_{10}/(2\pi BF)$. Appropriate values of $Q_{10}$ for different BFs have been estimated for humans (Heinz, M. G., Zhang, X., Bruce, I. C., and Carney, L. H., 2001, "Auditory nerve model for predicting performance limits of normal and impaired listeners," Acoustics Research Letters Online 2(3): 91–96; Heinz, M. G., Colburn, H. S., and Carney, L. H., 2002, "Quantifying the implications of nonlinear cochlear tuning for auditory-filter estimates," J. Acoust. Soc. Am., 111, 996–1011.)

The value of the time constant $\tau_{wide}$ determines the maximum bandwidth and the minimum gain of the signal-path filter 316. The difference in filter gain between $\tau_{narrow}$ and $\tau_{wide}$ is referred to as the cochlear amplifier (CA) gain. Based on the third-order nonlinear filter, $\tau_{wide}=\tau_{narrow}10^{-gainCA(BF)/60}$, where $gain_{CA}(BF)$ is provided below for a given BF. The CA gain also determines the strength of BM compression and two-tone rate suppression.

In order to model the effects of OHC status on the signal path filter 316, a scaling constant $C_{OHC}$ is introduced at the output of the control path in block 312, such that $\tau_{sp_impaired}[n]=C_{OHC}(\tau_{sp}[n]-\tau_{wide})+\tau_{wide}$, where $0<C_{OHC}<1$. Scaling $\tau_{sp}$ in this fashion produces a linear change in the filter's $Q_{10}$ as a function of $C_{OHC}$. For example if $C_{OHC}=0.5$, then the filter's $Q_{10}$ will be halfway between the filter's $Q_{10}$ value for normal OFC function ($C_{OHC}=1$) and its $Q_{10}$ value for complete OHC impairment ($C_{OHC}=0$). It is possible to apply an alternative scaling method $\tau^{sp}{}_{_impaired}[n]=\tau_{sp}[n](\tau_{wide}/\tau_{sp}[n])^{1-C'OHC}$ so that the gain in dB changes linearly (i.e. a log-linear fit) with an alternative scaling factor $C'_{OHC}$.

To model normal OHC function, $C_{OHC}$ is set to 1 and consequently the signal path filter 316 behavior is normal: tuning curves are narrow and thresholds are low. Upward "notches" in the resulting tuning curves just above 4 kHz are due to a notch in the ME filter 302. With $C_{OHC}=1$ the BM filter 316 exhibits compression for a BF tone from ~30 dB SPL to>100 dB SPL. The hearing model 300 also exhibits two-tone suppression due to the behavior of the wideband nonlinear filter which is also apparent in responses to vowel stimuli.

To model impaired OHC function, $C_{OHC}$ is set to some value between 1 and 0; the lower the value, the greater the impairment. Reducing $C_{OHC}$ causes two changes in the signal path filter 316 behavior. First, the effect when the control path signal 328 is small (i.e., at low sound levels) is to increase the tuning curve bandwidth and elevate thresholds around BF for filter 316. Thresholds in the low-frequency "tail" of the tuning curve decrease slightly with increasing impairment. This behavior is qualitatively consistent with physiological reports of hypersensitive tails in tuning curves with OHC impairment. In addition, a small downward shift in BF is observed for the model fiber with an unimpaired BF of 2.5 kHz (this shifted BF following impairment is referred to as the "impaired BF"). The shift is due to the effects of the ME filter 302 and IHC LP filter 322 on the tuning curve shape, not a change in the center frequency of the BM filter 316, and only occurs in the steep transition bands of the ME and IHC filters 302 and 316. Upward shifts of less than 0.15 octave occur for unimpaired BFs less than 0.5 kHz (i.e., in the high-pass transition band of the ME filter 302) and between ~4.2 and 5.0 kHz (i.e., in the upper edge of the notch of the ME filter 302). Downward shifts of less than 0.35 octave occur for unimpaired BFs between ~1.3 and 4.2 kHz (i.e., in the lower edge of the notch of the ME filter 302 and the low-pass transition band of the IHC filter 316). Second, when the control path signal 328 is significant (i.e., at moderate to high stimulus intensities), compression and suppression are reduced because of the scaling down of the time-varying component of $\tau_{sp}[n]$. The extreme case of $C_{OHC}=0$ describes complete loss of OHC function. At this point, tuning curves are at their highest and broadest and compression and suppression are completely lost.

In order for the hearing model 300 to predict data from populations of AN fibers, the levels of OHC and IHC impairment as a function of BF must be estimated. The following method is used to model data from single impaired AN fibers. First, the value of $\upsilon_{narrow}$ is set in the hearing model 300 using the $Q_{10}$ value of an examplary normal fiber with approximately matching BF. Second, a value for COHC is used that explains the estimated $Q_{10}$ value of an examplary impaired fiber. Third, enough IHC impairment is applied to explain the remaining threshold shift not accounted for by the OHC impairment.

In the hearing model 300, elevated threshold tuning curves due to IHC impairment can be modeled by decreasing the slope of the function that relates BM vibration to IHC potential (i.e. the IHCNL block 318). At the same time, the saturation potential must remain the same to retain maximum discharge rates close to those of normal fibers. Both of these effects can be achieved together in the model by decreasing the slope of the NL block 320, or equivalently by scaling down the output of the narrow-band BM filter 316 at the input of the IHC non-linearity 318 using a scaling constant $C_{IHC}$, where $0<C_{IHC}<1$. A value of one produces normal IHC function and a value of zero gives total IHC dysfunction. To model individual examplary fibers, a value for $C_{IHC}$ is chosen that accounts for the threshold shift not explained by OHC impairment.

There are also other more accurate hearing tests available to obtain more specific estimates of the IHC and OHC damage levels for a particular individual.

The hearing model 300 has the ability to capture a range of phenomena due to hair cell non-linearities, including loudness-dependent threshold and bandwidth modulation (as stimulus intensity increases, loudness sensitivity levels off and frequency-tuning becomes broader), as well as masking effects such as two-tone suppression. Additionally, the hearing model 300 incorporates critical properties of the auditory nerve response including synchrony capture in the normal and damaged ear and replicates several fundamental phenomena observed in electrophysiological experiments in animal auditory systems subjected to noise-induced hearing loss. For example, with OHC damage, high frequency auditory nerve fibers' tuning curves become asymmetrically broadened toward the lower frequencies. Exacerbating this problem, high-frequency fibers tend to become synchronously phase-locked to lower frequencies. Given accurate measurements of both inner and outer hair cell loss over a range of frequencies, the model could be tailored to compensate for many individual patterns of deficits. For example, an individual may have a complete loss of sensitivity in a small region (a notched hearing loss) and experience heightened sensitivity and possibly tinnitus due to enhancement and synchrony capture of the edge frequencies near the notch.

In use, the hearing-aid system 10 must be "tuned-up" or trained. In particular, the compensators 26 and 34 are first tuned binaurally in a quiet environment. Binaural training means that there may be two compensators, one in each channel as shown in FIG. 1, that are tuned together or there may be the case where only one channel is needed (i.e. a person with a hearing impairment in one auditory channel) and the compensator would be binaurally tuned with the person's good auditory channel. The binaural tuning is such that the neuronal signals from each auditory channel arrive at the auditory cortex in a synchronous manner so that the neuronal signals will reinforce one another when they reach the auditory cortex. The Neuro-compensator(s) 26(34) are tuned by training their weights using a peripheral auditory model fitted to a hearing-impaired individual's particular IHC and OHC damage percentages. The correlative units 24 and 32 are "tuned-up" binaurally in the end user's typical environment. The correlative units 24 and 32 are "tuned-up" by embedding some prior knowledge of the hearing aid user's listening environment. At this point, the adaptive delay unit 28 would also be "tuned-up". The adaptive delay unit 28 is preferably programmed to have a frequency selective phase delay. The adaptive delay unit 28 is tuned up in a way that the benefit of lip-reading (in enhancing signal-to-noise ratio) is maintained. This will be done on a subject-by-subject basis. The tuning is done in a binaural fashion as discussed above. All of this tuning is referred to as coarse adjustments which are done before the hearing-aid system 10 is used in the field. Both the compensators 26 and 34 and the correlative units 24 and 32 also have "online training" that is done on-the-fly in the field for environmental adjustment. The tuning of each block is provided in the description of each block of the hearing-aid system 10.

The invention described above makes a fundamental improvement to all subcomponents in state-of-the-art hearing-aids. The typical advanced DSP hearing-aids that are currently on the market have similar components: a directional filtering block, a noise reduction block, and an audiogram fitting block. However, the invention described herein improves on directional filtering by introducing environmentally adaptive spatial filtering, noise reduction is greatly enhanced by ACT, and the simple linear, or compressive fitting strategies are replaced by the Neuro-compensator's ability to mimic the nonlinearities and time adaptations lost to sensorineural hearing impairment.

There are various versions of the hearing-aid system 10 that hearing impaired individuals will find useful. As mentioned previously, the hearing impaired individual may have a hearing deficiency in the left auditory peripheral channel, in the right auditory peripheral channel or in both the left and right auditory peripheral channels. Accordingly, the hearing-aid system 10 may be a binaural hearing-aid system with both channels as shown in FIG. 1. An alternative would be the case where the adaptive delay unit is not needed since the signals that are processed by the two channels are already synchronized at the auditory cortex. Alternatively, for a hearing impaired person with one good auditory peripheral channel, an embodiment of the hearing-aid system 10 will have the correlative unit and the compensator (which are tuned with the good auditory peripheral channel to have the binaural effect) in the path that corresponds to the damaged auditory peripheral channel and then have the processing delay in the good auditory peripheral channel.

It should be understood by those skilled in the art that the hearing-aid system may be implemented using at least one digital signal processor as well as dedicated hardware such as application specific integrated circuits or field programmable arrays. Most operations are preferably done digitally. Accordingly, the units referred to in the embodiments described herein may be implemented by software modules or dedicated circuits.

It should also be understood that various modifications can be made to the preferred embodiments described and illustrated herein, without departing from the present invention.

The invention claimed is:

1. A hearing-aid system for processing an acoustic input signal and providing at least one output acoustic signal to a user of the hearing-aid system, the hearing-aid system comprising a first channel and a second channel, wherein one of the channels includes an adaptive delay and the first channel includes:

a) a first directional unit for receiving the acoustic input signal and providing a first directional signal;

b) a first correlative unit coupled to the first directional unit for receiving the first directional signal and providing a first noise reduced signal by utilizing correlative measures for identifying a speech signal of interest in the first directional signal; and, c) a first compensator coupled to the first correlative unit for receiving the first noise reduced signal and providing a first compensated signal for compensating for a hearing loss of the user, the first compensator including:

i) a normal hearing model unit for receiving an input signal and generating a normal hearing signal;

ii) a neuro-compensator unit for receiving the input signal and providing a pre-processed signal by applying a set of weights to the input signal;

iii) a damaged hearing model unit connected to the neuro-compensator unit for receiving the pre-processed signal and providing an impaired hearing signal; and, iv) a comparison unit connected to the normal hearing model unit and the damaged hearing model unit for generating an error signal based on a comparison of the normal hearing signal and the impaired hearing signal;

wherein, the error signal is provided to the neuro-compensator unit for adjusting the set of weights such that the normal hearing signal and the impaired hearing signal are substantially similar.

2. The hearing-aid system of claim 1, wherein the second channel includes:

d) a second directional unit for receiving the acoustic input signal and providing a second directional signal;

e) a second correlative unit coupled to the second directional unit for receiving the second directional signal and providing a second noise reduced signal by utilizing correlative measures for identifying a speech signal of interest in the second directional signal; and, f) a second compensator coupled to the second correlative unit for receiving the second noise reduced signal and providing a second compensated signal for compensating for a hearing loss of the user.

3. The hearing-aid system of claim 2, wherein the adaptive delay provides an appropriate delay to one of the first compensated signal and the second compensated signal for matching processing delay in the first and second channels.

4. The hearing-aid system of claim 1, wherein the correlative measures are provided by atomic decomposition phonemic processing.

5. The hearing-aid system of claim 4, wherein the atomic decomposition phonemic processing comprises mapping a portion of the first directional signal into a five-dimensional space which comprises dimensions of: duration in time, duration in frequency, temporal centers of gravity, spectral centers of gravity, and change of spectral centers of gravity.

6. The hearing-aid system of claim 5, wherein the mapping is performed according to:

$$h_{T_c,F_c,\sigma_T,\sigma_F,\beta}(t,f)=\frac{1}{2\pi\sigma_T^2\sigma_F^2}e^{-\left[\frac{1}{2(1-\beta^2)}\left(\frac{(t-T_c)^2}{\sigma_T^2}-\frac{2\beta(t-T_c)(f-F_c)}{\sigma_T\sigma_F}+\frac{(f-F_c)^2}{\sigma_F^2}\right)\right]}.$$

7. The hearing-aid system of claim 4, wherein the atomic decomposition phonemic processing comprises correlating an atom with a portion of the first directional signal according to:

$$\gamma_p=\arg\max_{\gamma}|\langle s_{p-1}(t),\ f(\sigma_T,\sigma_F)h_\gamma(t)\rangle|^2.$$

8. The hearing-aid system of claim 1, wherein the correlative measures are provided by acoustic correlative tracking and the first correlative unit comprises:

d) a correlator generator for receiving a second input signal and generating a plurality of speech and environmental correlates;

e) a control unit coupled to the correlator generator for receiving the speech correlates and the environmental correlates and generating a control signal; and, f) a processing unit coupled to the correlator generator and the control unit, the processing unit receiving the second input signal, the speech correlates and the control signal and processing the speech correlates according to the control signal for extracting speech from the second input signal.

9. The hearing-aid system of claim 8, wherein the processing unit processes the second input signal by selecting appropriate speech correlates based on the environmental correlates and tracking the appropriate speech correlates.

10. The hearing-aid system of claim 9, wherein the processing unit employs one of a Kalman filter and a particle filter for tracking the appropriate speech correlates.

11. The hearing-aid system of claim 1, wherein the neuro-compensator is a neural network.

12. The hearing-aid system of claim 11, wherein the neuro-compensator applies a set of gain coefficients to the input signal, each gain coefficient being defined for a particular frequency band i according to $$G_i=\frac{v_i f_i^2}{\sum_j w_{ij} f_j^2+\sigma}$$

where $f_i^2$ is energy at frequency band i, $w_{ij}$ is a weight at frequency band i and $\sigma$ is a constant related to the energy $f_i^2$.

13. The hearing-aid system of claim 11, wherein a weight $W_i$ from the set of weights is defined for a particular time-slice at the $i^{th}$ frequency band according to $$W_i = \frac{v_i}{\left(\sum_{j=1}^{20} w_{ij} f_j\right)^{\frac{1}{4}} + \left[\sum_{k=0}^{4}\left(z_{ik}\sum_{j=1}^{20} f_j^{n-k}\right)^{\frac{1}{4}}\right] + \sigma}$$

where $f_j$ is the magnitude of the input signal in the $j^{th}$ frequency band, $v_i$ is optimized average gain, $w_{ij}$ is optimized band to band inhibition, $z_{ik}$ is optimized total power inhibition for past times and $\sigma$ is a constant.

14. The hearing-aid system of claim 1, wherein the error signal is defined according to a Neural Articulation Index (NAI) of the form $$NAI = \sum_{i=1}^{N} \alpha_i \cdot ND_i$$

where N is a number of frequency bands, $\alpha_i$ is a weight for frequency band i, and ND (Neural Distortion) is defined by $$ND = 1 - \frac{\text{Test} \cdot \text{Control}'}{\text{Control} \cdot \text{Control}'}$$

where Test is a vector of instantaneous spiking rates provided by the damaged hearing model unit and Control is a vector of instantaneous spiking rates provided by the normal hearing model unit.

15. A compensator for compensating for hearing loss in a hearing-aid, the compensator comprising:

a) a normal hearing model unit for receiving an input signal and generating a normal hearing signal;

b) a neuro-compensator unit for receiving the input signal and providing a pre-processed signal by applying a set of weights to the input signal;

c) a damaged hearing model unit connected to the neuro-compensator unit for receiving the pre-processed signal and providing an impaired hearing signal; and, d) a comparison unit connected to the normal hearing model unit and the damaged hearing model unit for generating an error signal based on a comparison of the normal hearing signal and the impaired hearing signal;

wherein, the error signal is provided to the neuro-compensator unit for adjusting the set of weights such that the normal hearing signal and the impaired hearing signal are substantially similar.

16. The compensator of claim 15, wherein the neuro-compensator is a neural network.

17. The compensator of claim 16, wherein the neuro-compensator applies a set of gain coefficients to the input signal, each gain coefficient being defined for a particular frequency band i according to $$G_i = \frac{v_i f_i^2}{\sum_j w_{ij} f_j^2 + \sigma}$$

where $f_i^2$ is energy at frequency band i, $w_{ij}$ is a weight at frequency band i and $\sigma$ is a constant related to the energy $f_i^2$.

18. The compensator of claim 16, wherein a weight $W_i$ from the set of weights is defined for a particular time-slice at the $i^{th}$ frequency according to $$W_i = \frac{v_i}{\left(\sum_{j=1}^{20} w_{ij} f_j\right)^{\frac{1}{4}} + \left[\sum_{k=0}^{4}\left(z_{ik}\sum_{j=1}^{20} f_j^{n-k}\right)^{\frac{1}{4}}\right] + \sigma}$$

where $f_j$ is the magnitude of the input signal in the $j^{th}$ frequency band, $v_i$ is optimized average gain, $w_{ij}$ is optimized band to band inhibition, $z_{ik}$ is optimized total power inhibition for past times and $\sigma$ is a constant.

19. The compensator of claim 15, wherein the error signal is defined according to a Neural Articulation Index (NAI) of the form $$NAI = \sum_{i=1}^{N} \alpha_i \cdot ND_i$$

where N is a number of frequency bands, $\alpha_i$ is a weight for frequency band i, and ND (Neural Distortion) is defined by $$ND = 1 - \frac{\text{Test} \cdot \text{Control}'}{\text{Control} \cdot \text{Control}'}$$

where Test is a vector of instantaneous spiking rates provided by the damaged hearing model unit and Control is a vector of instantaneous spiking rates provided by the normal hearing model unit.

20. A method of processing an acoustic input signal and providing at least one output acoustic signal to a user of a hearing-aid system, the method comprising providing a first channel and a second channel, wherein one of the channels includes an adaptive delay, and for the first channel, the method comprises:

a) providing directional processing to the acoustic input signal for generating a first directional signal;

b) processing the first directional signal for providing a first noise reduced signal by utilizing correlative measures for identifying a speech signal of interest in the first directional signal; and, c) processing the first noise reduced signal for providing a first compensated signal for compensating for a hearing loss of the user by;

i) receiving an input signal and generating a normal hearing signal based on a normal hearing model;

ii) receiving the input signal and providing a pre-processed signal by applying a set of weights to the input signal;

iii) receiving the pre-processed signal and providing an impaired hearing signal based on an impaired hearing model; and, iv) generating an error signal based on a comparison of the normal hearing signal and the impaired hearing signal;

wherein, the error signal is used to adjust the set of weights such that the normal hearing signal and the impaired hearing signal are substantially similar.

21. The method of claim 20, wherein for the second channel the method includes:

d) providing directional processing to the acoustic input signal for generating a second directional signal;

e) processing the second directional signal for providing a second noise reduced signal by utilizing correlative measures for identifying a speech signal of interest in the second directional signal; and, f) processing the second noise reduced signal for providing a second compensated signal for compensating for a hearing loss of the user.

22. The method of claim 21, wherein the method further comprises providing an appropriate delay to one of the first compensated signal and the second compensated signal for matching processing delay in the first and second channels.

23. The method of claim 20, wherein the method further comprises utilizing atomic decomposition phonemic processing for generating the correlative measures.

24. The method of claim 23, wherein the atomic decomposition phonemic processing comprises mapping a portion of the first directional signal into a five-dimensional space which comprises dimensions of: duration in time, duration in frequency, temporal centers of gravity, spectral centers of gravity, and change of spectral centers of gravity.

25. The method of claim 24, wherein the mapping is performed according to:

$$h_{T_c,F_c,\sigma_T,\sigma_F,\beta}(t,f)=\frac{1}{2\pi\sigma_T^2\sigma_F^2}e^{-\left[\frac{1}{2(1-\beta^2)}\left(\frac{(t-T_c)^2}{\sigma_T^2}-\frac{2\beta(t-T_c)(f-F_c)}{\sigma_T\sigma_F}+\frac{(f-F_c)^2}{\sigma_F^2}\right)\right]}.$$

26. The method of claim 23, wherein the atomic decomposition phonemic processing comprises correlating an atom with a portion of the first directional signal according to:

$$\gamma_p=\arg\max_{\gamma}|\langle s_{p-1}(t),\ f(\sigma_T,\sigma_F)h_\gamma(t)\rangle|^2.$$

27. The method of claim 20, wherein the method further comprises providing acoustic correlative tracking for generating the correlative measures, wherein the acoustic correlative tracking comprises:

d) receiving a second input signal and generating a plurality of speech and environmental correlates;

e) receiving the speech correlates and the environmental correlates and generating a control signal; and, f) processing the speech correlates according to the control signal for extracting speech from the second input signal.

28. The method of claim 27, wherein processing the speech correlates includes selecting appropriate speech correlates based on the environmental correlates and tracking the appropriate speech correlates.

29. The method of claim 20, wherein applying the set of weights results in applying a set of gain coefficients to the input signal, each gain coefficient being defined for a particular frequency band i according to $$G_i=\frac{v_i f_i^2}{\sum_j w_{ij} f_j^2+\sigma}$$

where $f_i^2$ is energy at frequency band i, $w_{ij}$ is a weight at frequency band i and σ is a constant related to the energy $f_i^2$.

30. The method of claim 20, wherein a weight $W_i$ from the set of weights is defined for a particular time-slice at the $i^{th}$ frequency band according to $$W_i=\frac{v_i}{\left(\sum_{j=1}^{20} w_{ij} f_j\right)^{1/4}+\left[\sum_{k=0}^{4}\left(z_{ik}\sum_{j=1}^{20} f_j^{n-k}\right)^{1/4}\right]+\sigma}$$

where $f_j$ is the magnitude of the input signal in the $j^{th}$ frequency band, $v_i$ is optimized average gain, $w_{ij}$ is optimized band to band inhibition, $z_{ik}$ is optimized total power inhibition for past times and σ is a constant.

31. The method of claim 20, wherein the error signal is defined according to a Neural Articulation Index (NAI) of the form $$NAI=\sum_{i=1}^{N}\alpha_i\cdot ND_i$$

where N is a number of frequency bands, $\alpha_i$ is a weight for frequency band i, and ND (Neural Distortion) is defined by $$ND=1-\frac{\text{Test}\cdot\text{Control}'}{\text{Control}\cdot\text{Control}'},$$

where Test is a vector of instantaneous spiking rates generated by the damaged hearing model and Control is a vector of instantaneous spiking rates provided by the normal hearing model.

32. A method of compensating for hearing loss in a hearing-aid, the method comprising:

a) receiving an input signal and generating a normal hearing signal based on a normal hearing model;

b) receiving the input signal and providing a pre-processed signal by applying a set of weights to the input signal;

c) receiving the pre-processed signal and providing an impaired hearing signal based on an impaired hearing model; and, d) generating an error signal based on a comparison of the normal hearing signal and the impaired hearing signal;

wherein, the error signal is used to adjust the set of weights such that the normal hearing signal and the impaired hearing signal are substantially similar.

33. The method of claim 32, wherein applying the set of weights results in applying a set of gain coefficients to the input signal, each gain coefficient being defined for a particular frequency band i according to $$G_i=\frac{v_i f_i^2}{\sum_j w_{ij} f_j^2+\sigma}$$

where $f_i^2$ is energy at frequency band i, $w_{ij}$ is a weight at frequency band i and σ is a constant related to the energy $f_i^2$.

34. The method of claim 32, wherein a weight $W_i$ from the set of weights is defined for a particular time-slice at the $i^{th}$ frequency band according to $$W_i = \frac{v_i}{\left(\sum_{j=1}^{20} w_{ij} f_j\right)^{\frac{1}{4}} + \left[\sum_{k=0}^{4}\left(z_{ik}\sum_{j=1}^{20} f_j^{n-k}\right)^{\frac{1}{4}}\right] + \sigma}$$

where $f_j$ is the magnitude of the input signal in the $j^{th}$ frequency band, $v_i$ is optimized average gain, $w_{ij}$ is optimized band to band inhibition, $z_{ik}$ is optimized total power inhibition for past times and $\sigma$ is a constant.

35. The method of claim 32, wherein the error signal is defined according to a Neural Articulation Index (NAI) of the form $$NAI = \sum_{i=1}^{N} \alpha_i \cdot ND_i$$

where N is a number of frequency bands, $\alpha_1$ is a weight for frequency band i, and ND (Neural Distortion) is defined by $$ND = 1 - \frac{\text{Test} \cdot \text{Control}'}{\text{Control} \cdot \text{Control}'}$$

where Test is a vector of instantaneous spiking rates provided by the damaged hearing model and Control is a vector of instantaneous spiking rates provided by the normal hearing model.

* * * * *

UNITED STATES PATENT AND TRADEMARK OFFICE

CERTIFICATE OF CORRECTION

PATENT NO. : 7,149,320 B2
APPLICATION NO. : 10/733451
DATED : December 12, 2006
INVENTOR(S) : Simon Haykin et al.

It is certified that error appears in the above-identified patent and that said Letters Patent is hereby corrected as shown below:

In the Title (item 54 and column 1, line 1), the word "AID" has been changed to --SYSTEM--, so that the title reads --BINAURAL ADAPTIVE HEARING SYSTEM--.

In the Detailed Description Of The Invention section, column 9, line 18, equation 2 has been changed to -- $\gamma_p = \arg\max_{\gamma} \left|\left\langle s_{p-1}(t), h_\gamma(t)\right\rangle\right|^2$, and $b_p = \left\langle s_{p-1}(t), h_{\gamma_p}(t)\right\rangle$.--

In the Detailed Description Of The Invention section, column 17, line 40, the letter "a" has been changed to the symbol --σ--, so that the line reads --tests σ was set to 1 percent of the mean value of $f_i^2$ although--.

In the Detailed Description Of The Invention section, column 17, line 41, the letter "a" has been changed to the symbol --σ--, so that the line reads --other values can be used for σ to ensure that the model never--.

In the Detailed Description Of The Invention section, column 26, line 38, the first instance of the word "$\tau^{sp}$" has been changed to --$\tau_{sp}$--, so that the line reads --an alternative scaling method $\tau_{sp_impaired}[n] = \tau_{sp}[n](\tau_{wide}/\tau_{sp}$--.

UNITED STATES PATENT AND TRADEMARK OFFICE

CERTIFICATE OF CORRECTION

PATENT NO. : 7,149,320 B2
APPLICATION NO. : 10/733451
DATED : December 12, 2006
INVENTOR(S) : Simon Haykin et al.

It is certified that error appears in the above-identified patent and that said Letters Patent is hereby corrected as shown below:

In the Claims, column 32, line 51, claim 20, section c, the punctuation ";" has been changed to --:--, so that the line reads --hearing loss of the user by :--.

Signed and Sealed this

Third Day of July, 2007

JON W. DUDAS
*Director of the United States Patent and Trademark Office*